US008511021B2

(12) United States Patent
Salisbury et al.

(10) Patent No.: US 8,511,021 B2
(45) Date of Patent: Aug. 20, 2013

(54) STRUCTURAL CAP WITH COMPOSITE SLEEVES

(75) Inventors: Nickolas G. Salisbury, Coeur d'Alene, ID (US); Kenneth R. Edmonds, Spokane Valley, WA (US)

(73) Assignee: Crux Subsurface, Inc., Spokane Valley, WA (US)

( * ) Notice: Subject to any disclaimer, the term of this patent is extended or adjusted under 35 U.S.C. 154(b) by 55 days.

(21) Appl. No.: 13/087,294

(22) Filed: Apr. 14, 2011

(65) Prior Publication Data

US 2012/0096786 A1 Apr. 26, 2012

Related U.S. Application Data

(60) Provisional application No. 61/325,221, filed on Apr. 16, 2010.

(51) Int. Cl.
*E02D 27/00* (2006.01)

(52) U.S. Cl.
USPC ..... 52/296; 52/301; 52/150; 405/231

(58) Field of Classification Search
USPC ..... 52/292, 296, 294, 301, 169.9, 150, 52/151, 165; 405/231–257, 227; 248/677
See application file for complete search history.

(56) References Cited

U.S. PATENT DOCUMENTS

| | | | | |
|---|---|---|---|---|
| 3,328,969 | A | 7/1967 | Murphy et al. | |
| 3,590,930 | A | 7/1971 | Gronfors | |
| 3,946,570 | A | 3/1976 | Freydier | |
| 3,992,831 | A | 11/1976 | Bukovitz et al. | |
| 4,023,325 | A | 5/1977 | Paverman | |
| 4,068,445 | A * | 1/1978 | Bobbitt | 52/741.11 |
| 4,606,155 | A | 8/1986 | Bukovitz et al. | |
| 4,735,527 | A | 4/1988 | Bullivant | |
| 5,213,169 | A | 5/1993 | Heller | |
| 5,226,488 | A | 7/1993 | Lessard et al. | |
| 5,256,004 | A | 10/1993 | Gemmi et al. | |
| 5,873,679 | A * | 2/1999 | Cusimano | 405/231 |
| 5,908,268 | A | 6/1999 | Yabuuchi | |
| 6,012,874 | A | 1/2000 | Groneck et al. | |
| 6,354,766 | B1 | 3/2002 | Fox | |
| 7,618,217 | B2 * | 11/2009 | Henderson | 405/255 |
| 7,993,107 | B2 * | 8/2011 | Gevers | 416/244 R |
| 8,109,057 | B2 * | 2/2012 | Stark | 52/297 |
| 2009/0307998 | A1 * | 12/2009 | Zavitz et al. | 52/152 |

* cited by examiner

*Primary Examiner* — William Gilbert
*Assistant Examiner* — Gisele Ford
(74) *Attorney, Agent, or Firm* — Lee & Hayes, PLLC

(57) ABSTRACT

The disclosure describes, in part, techniques for designing, fabricating and installing structural caps with a core and composite sleeves to be coupled to structural members of a foundation, such as an installed radial array of batter angled micropiles. These structural caps with sleeves are lightweight and, thus, more portable to difficult-access sites. Once at the sites, operators may fixedly couple these caps to the micropiles or other structural members to form a foundation for a structure to be installed at the difficult-access site.

50 Claims, 31 Drawing Sheets

EXAMPLE SLIDE POSITIONS OF DRILL BASE SLIDE PLATE

Example Mast Angle Positions of Rotating Drill

1600

| Tower Details 1602 | | | | | Foundation Details and Decision Matrix 1604 | | | | | | | | | | | | | | | | | | | |
|---|---|---|---|---|---|---|---|---|---|---|---|---|---|---|---|---|---|---|---|---|---|---|---|---|
| Tower No. | Tower Type | Body Extension | Tower Leg Extension (ft) | | Projection (ft) | T.O.C. Elevation (ft) | B.O.C. Elevation (ft) | Bearing Plate Elevation[H] (ft) | 'B' T.O.P. to B.O.C. (ft) | Array Diameter | Batter Angle | Casing Diameter (in) | Rebar Diameter (in) | Strata at 3.0' (Point of Characterization) | No. Piles | N Value | Upper Strata Cased Zone[E] | Min. Casing Embedment into Unit[D] (ft) | N Value | Lower Strata Bond Zone[E] | Min. Bond Length, $L_b$ (ft) | Micropile Type | N Value |
| 29 | EMS | 24 | A | 6 | 0.8 | 2103.3 | 2099.1 | 2100.97 | 1.9 | 33" | 10° | 5 1/2 | 1 3/8 | Loose | 4 | | Loose | 12 | | Loose | 23.5 | B | |
| | | | | | | | | | | | | | | | | | Medium Dense | 10 | | Medium Dense | 16 | B | |
| | | | B | 9 | 2.5 | 2100.3 | 2096.1 | 2097.97 | 1.9 | | | | | | | | Rock | 9 | | Rock | 10 | 0 | |
| | | | | | | | | | | | | | | Med Dense Rock | 3 | N29 | Loose | N/A | | Loose | 39 | B | |
| | | | C | 6 | 1.6 | 2103.3 | 2099.1 | 2100.97 | 1.9 | | | | | | | | Medium Dense | 10 | N29 | Medium Dense | 26.5 | B | |
| | | | D | 9 | 0.7 | 2100.3 | 2096.1 | 2097.97 | 1.9 | | | | | | | | Rock | 9 | | N/A | 10 | 0 | N53 |
| 30 | EMS | 24 | A | 6 | 0.9 | 2109.6 | 2105.4 | 2107.27 | 1.9 | 33" | 10° | 5 1/2 | 1 3/8 | Loose | 4 | | Loose | 12 | | Loose | 23.5 | B | |
| | | | | | | | | | | | | | | | | | Medium Dense | 10 | | Medium Dense | 16 | B | |
| | | | B | 9 | 2.2 | 2106.6 | 2102.4 | 2104.27 | 1.9 | | | | | | | | Rock | 9 | | Siltstone | 10 | A | |
| | | | | | | | | | | | | | | Med Dense Rock | 3 | | Loose | N/A | | Loose | 39 | B | |
| | | | C | 6 | 0.8 | 2109.6 | 2105.4 | 2107.27 | 1.9 | | | | | | | | Medium Dense | 10 | | Medium Dense | 26.5 | B | |
| | | | D | 9 | 0.5 | 2106.6 | 2102.4 | 2104.27 | 1.9 | | | | | | | | Rock | 9 | | Siltstone | 15.5 | A | |

Loose: N = 4 - 11 Medium Dense: N = 12 - 39 Rock: N = 40+

Fig. 16

STRUCTURAL CAP WITH COMPOSITE SLEEVES

PRIORITY

This application claims the benefit of the filing date of U.S. Provisional Application No. 61/325,221 filed on Apr. 16, 2010, which is incorporated by reference herein in its entirety.

BACKGROUND

Companies that operate within the geotechnical construction industry often engage in a variety of different excavation projects to install a variety of different structures. For instance, these companies may install a series of lattice towers or mono pole towers that collectively carry power lines or the like from one location to another. In some instances, however, the locations of these tower sites are remote and virtually inaccessible. Because of this inaccessibility, these companies employ techniques to install these towers with fewer materials and smaller tools than compared to traditional techniques used at more accessible sites. While these companies have proven successful at installing structures at remote and inaccessible sites, other more efficient and cost-effective techniques may exist.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components.

FIG. 16 illustrates an example foundation pile schedule and decision matrix for use with the example process of FIGS. 11-15.

DETAILED DESCRIPTION

Figure 1:
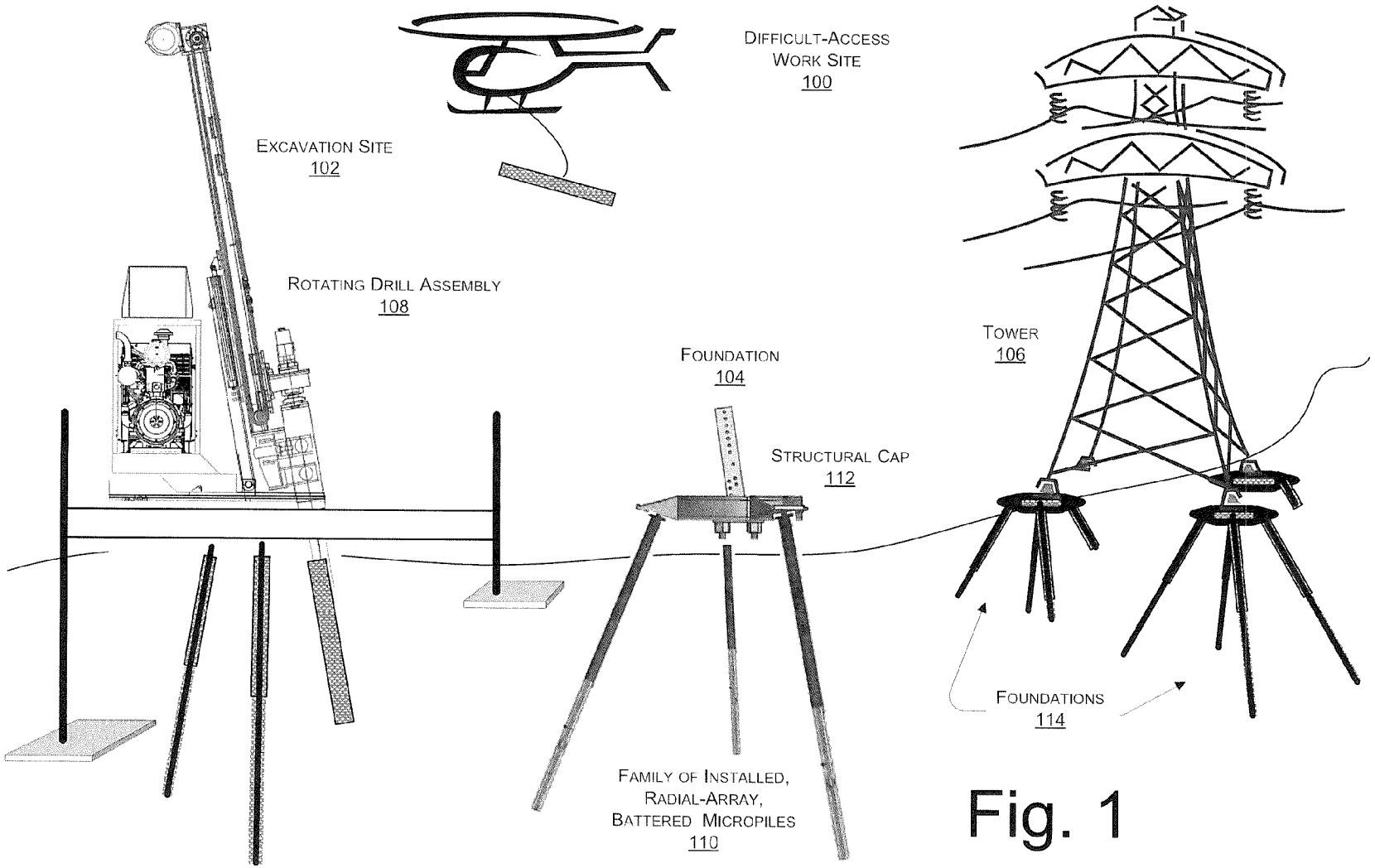
FIG. 1 illustrates an example difficult-access work site. This work site illustrates a lattice tower that has been installed on a radial array of battered micropiles. This works site also includes a rotating drill assembly for excavating a radial array of shafts, as well as a family of radial array battered micropiles coupled together with use of a structural cap having angled bearing flanges.

The disclosure describes, in part, apparatuses and methods for installing structures (e.g., foundations, footings, anchors, abutments, etc.) at work sites, such as difficult-access work sites. For instance, this disclosure describes an apparatus that includes a drill mounted to a rotating member and a sliding member, the combination of which couples to a platform. An operator may employ this rotating drill assembly to excavate a radial array of shafts and thereafter install a radial array of piles, such as a radial array of micropiles. In addition, because this rotating drill assembly comprises multiple detachable components as described in detail below, these components may be transported to a difficult-access work site and assembled directly over a predetermined target at the site. For instance, these components may be flown into the site via a helicopter, driven into the site by trucks or hoisted into the site via a crane and assembled onsite to create the rotating drill assembly.

This disclosure also describes processes for architecting custom structure designs (e.g., pile designs) based at least in part on geotechnical characteristics of particular excavation sites, as well on load requirements of the structure to be attached. For instance, an operator may employ the rotating drill assembly discussed above to perform one or more in-situ (on-site) penetration tests for a particular site. With the results of the penetration tests, the operator or another entity may determine the geotechnical characteristics of the site. The operator or another entity may then use this information in conjunction with a decision matrix described below to determine varying aspects of the structure design, such as a pile design or the like.

For instance, the operator may use the geotechnical characteristics of the site and the decision matrix determine a number of piles to include in a design, a length of a casing of the piles or a bond length of the piles. In some instances, the operator may perform this process at the excavation site and just prior to excavating the shafts and installing the piles. As such, this process may allow the operator to create a custom pile design tailored exactly to the characteristics of the work site just prior to implementing the pile design. Furthermore, in instances where the operator installs a series of structures, such as tower foundations at a tower site, the operator may create custom pile designs for each respective tower foundation as the operator progresses across the tower site.

In addition, this disclosure describes different structural caps that may be used to couple a group of pile together with one another. First, this disclosure describes a structural cap that comprises an outer shell (e.g., made of metal or another material) and a cementitious containment area that may be filled onsite with a cementitious mixture. As described in detail below, this structural cap may provide a strength found in traditional concrete caps, while requiring far less concrete than traditional caps. As such, the structural cap remains lightweight and, thus, more portable to difficult-access sites.

In one example, once an operator installs a group of piles (e.g., a radial array of micropiles) at a difficult-access work site, the operator may couple the installed group of piles with a structural cap that has been transported to the difficult-access site. The operator may then fill the cementitious containment area of the cap with the cementitious mixture, thus reinforcing the structural cap and providing additional strength to the resulting foundation. After a relatively short cure time, the operator or another entity may then couple the secured group of piles to a structure, such as a tower leg or the like.

In addition, this disclosure describes multiple different structural caps for coupling structural members to a leg of a structure, such as a tower. For instance, one such cap includes bearing flanges at angles that match a batter angle of an installed group of piles. For instance, if a group of piles is designed to include a particular batter angle, θ, a cap may be similarly designed to include bearing flanges at the angle, θ. When an operator thereafter installs the cap to the group of piles, each pile may perpendicularly mate with an aperture of a respective bearing flange. Therefore, the cap may properly and securely couple to the piles with use of fasteners.

Another type of structural cap described herein employs sleeves that couple to the cap on one end and to a group of structural members on the other end. By doing so, the resultant structural cap (including the sleeves) provides for a fixed coupling between a leg of a structure (e.g., a leg of a lattice tower) and the multiple structural members within a foundation. In some instances, the sleeves are configured to be disposed over the ends of the multiple structural members protruding from the foundation. The cap may in turn couple to the sleeves, which may in turn couple to the leg of the structure via a mounting member (e.g., a "stub angle"). After the sleeves are disposed over the ends of the structural members, an operator may backfill voids of the sleeves with a cementitious material. By doing so, the resultant structural cap provides fixity between the foundation and the tower leg.

Another type of structural cap described herein employs a core having bearing flanges fixed on the perimeter of the core. Similar to the structural cap that comprises an outer shell and a cementitious containment area that may be filled onsite with a cementitious mixture (illustrated in FIG. 18), the core of this structural cap also contains a cementitious mixture. Here, the core defines a void and comprises a tube in between a top plate and a bottom plate. The top plate of the core may comprise a post member attached to top plate opposite to a mounting member attached to the top plate. The post member may protrude into the void of the core to resist shear loads experienced by the structural cap. The post member may be any type of protruding member. For example, the protruding member may have a cross-sectional shape that is rectangular, round, oval, in the shape of a star, in the shape of a cruciform, or the like. The post member may be a bar, a tube, one or more plates, or the like suitable for protruding into the void of the core to resist shear loads experienced by the structural cap. The mounting member (e.g., a "stub angle") may protrude, distal from the core of the structural cap, to couple to a leg of a structure (e.g., a leg of a lattice tower). In addition, in some embodiments, the structural cap also employs sleeves that couple to the cap on one end and to a group of structural members on the other end. After the structural cap is assembled to the structural members, an operator may backfill voids of the sleeves and the core with a cementitious material. By doing so, the resultant structural cap provides fixity between the foundation and the tower leg.

The discussion begins with a section entitled "Example Difficult-Access Work Site," which describes one example environment in which the described apparatuses and methods may be implemented. A section entitled "Example Rotating Drill Assembly and Assembly Process" follows, and describes details of the rotating drill assembly from FIG. 1. This section also describes one example process for assembling the rotating drill at the difficult-access work site of FIG. 1 or otherwise. The discussion then proceeds to describe "Example Rotating Drill Assembly Adjustments" and example ways in which an operator may utilize the rotating drill assembly.

Next, a section entitled "Example Process for Architecting Custom Structure Designs" illustrates and describes a process for creating custom designs (e.g., pile designs) based at least in part on geotechnical characteristics specific to a work site. This section also includes an example foundation schedule that includes a decision matrix for use with the process described immediately above. A section entitled "Example Structural Caps and Associated Process" follows. This section describes the example structural caps for coupling piles, anchors or the like with one another, as well as an example process for designing and installing these caps. A section entitled "Example Structural Cap with Sleeves and Associated Processes" and its several subsections follow. An additional section entitled "Example Structural Caps with a Core and Sleeves and Associated Processes" follows. Finally, a brief conclusion ends the discussion.

This brief introduction, including section titles and corresponding summaries, is provided for the reader's convenience and is not intended to limit the scope of the claims, nor the proceeding sections.

Example Difficult-Access Work Site

FIG. 1 illustrates an example difficult-access work site 100 in which the described apparatuses and methods may be implemented. Difficult-access work site 100 depicts multiple stages that occur in the process of installing one or more structures at work site 100. Here, for instance, work site 100 illustrates several stages necessary to install a series of lattice towers designed to carry power lines or the like. While FIG. 1 illustrates constructing foundations and installing lattice towers thereon, the techniques described herein may be used to construct foundations, footings, anchors or the like for installing monopole towers, lattice towers or any other similar or different structure(s).

For instance, work site 100 illustrates an excavation site 102, a completed foundation 104 and an installed tower 106. Excavation site 102 represents a first stage of a process in constructing a tower at work site 100. Here, an operator of work site 100 may use a rotating drill assembly 108, described in detail below, to excavate one or more shafts, such as a radial array of shafts.

Next, foundation 104 represents a second stage in the process of constructing a tower. Here, the operator of the site has installed a family of radial-array, battered micropiles 110 within the excavated shafts. While FIG. 1 shows a radial array of micropiles, other implementations may employ other types of piles, anchors (e.g., rock anchors), or the like. In addition, FIG. 1 illustrates that the operator has coupled piles 110 together via a structural cap 112. In some instances described below, structural cap 112 may comprise a composite cap and/or other type of structural cap having flanges angled to match the batter angle of installed piles 110. In still other instances, the structural cap 112 may include sleeves, as discussed below, to provide fixity between the completed foundation and, for instance, a leg of a lattice tower.

Finally, FIG. 1 illustrates, on the right-hand side of the illustration, that the operator of site 100 has installed tower 106 to multiple foundations 114. As illustrated, each of foundations 114 comprises a family of radial-array, battered micropiles 110 coupled with a structural cap 112.

Because work site 100 may comprise a remote and virtually inaccessible environment, helicopters, cranes or other transportation means may support work site 100. In these instances, these transportation means function to deliver materials and tools to work site 100. For instance, the helicopter illustrated in FIG. 1 may provide drills, platforms, piles, structural caps, tower components or any other tools or components needed at site 100 to complete the foundations and towers coupled thereto. Because an operator of site 100 may need to deliver these tools and components to site 100 via a helicopter or the like, these tools and components may be relatively small and lightweight.

For instance, returning to excavation site 102, the illustrated helicopter may transport components of rotating drill assembly 108 to work site 100. After the helicopter transports the components of drill assembly 108, an operator of work site 100 may assemble rotating drill assembly 108. In addition, the helicopter may transport the materials necessary to install micropiles 110, structural cap 112, as well as tower 106.

Having described one example environment in which the apparatuses and methods described in detail below may be implemented, the discussion moves to a discussion of rotating drill assembly 108 and an example process for assembling this drill assembly. The reader will appreciate, however, that difficult-access work site 100 comprises but one of many environments that may implement the described apparatuses and methods.

Example Rotating Drill Assembly and Assembly Process

FIGS. 2-6 illustrate details of rotating drill assembly 108 of FIG. 1, as well as an example process 200 for assembling the drill assembly. In some instances, this process may be performed at a difficult-access work site, such as work site 100 of FIG. 1, after a helicopter or other transportation means transfers components of rotating drill assembly 108 to site 100. The order in which the operations are described in process 200 (as well as the remaining processes described herein) is not intended to be construed as a limitation, and any number of the described operations can be combined in any order and/or in parallel to implement the process. In addition, while process 200 is described as being performed by a same actor, the described operations may be performed by multiple different actors in some instances.

Figure 2:
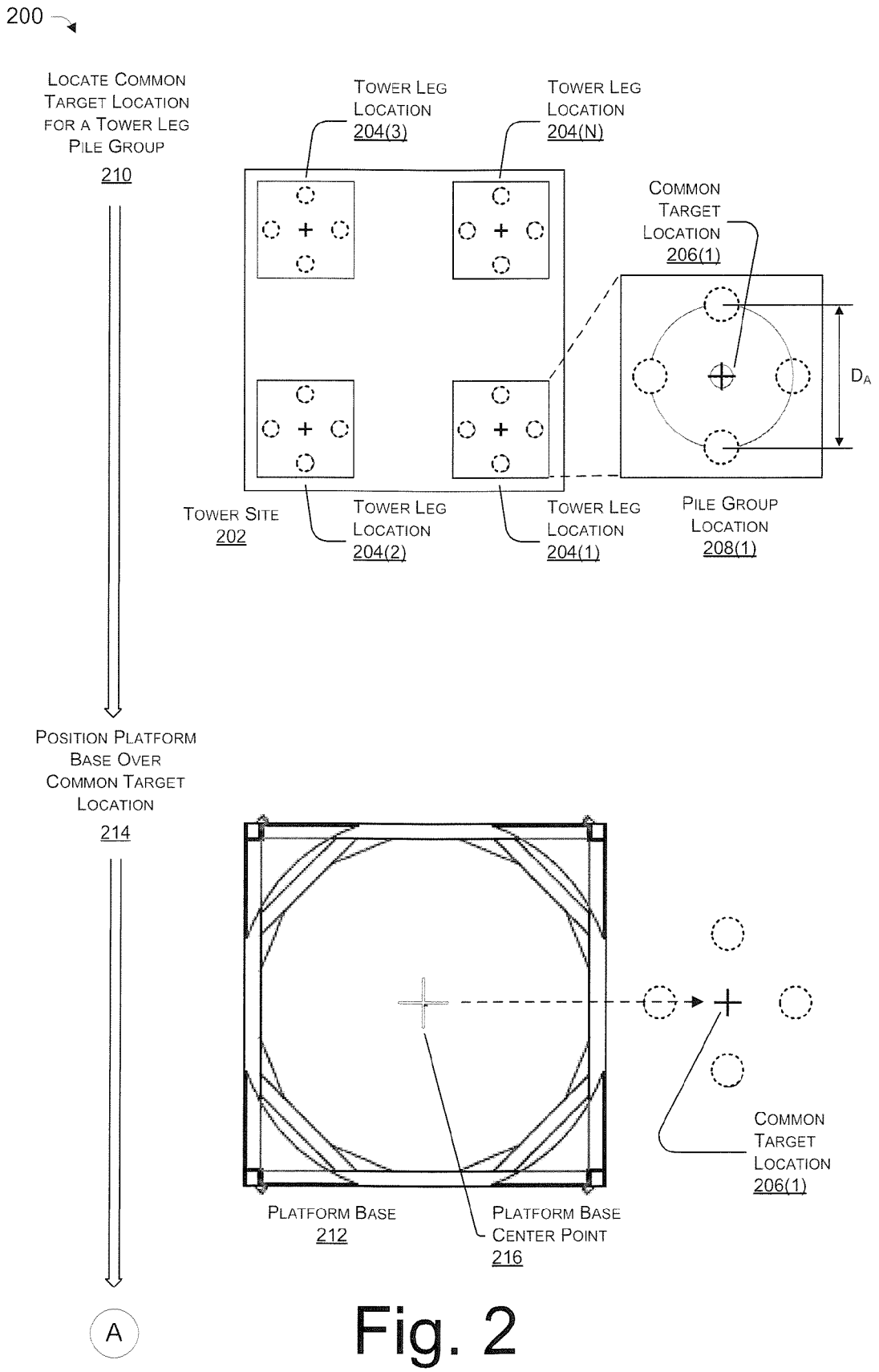
FIGS. 2-6 illustrate details of the rotating drill assembly of FIG. 1, as well as an example process for assembling the rotating drill assembly. In some instances, this process may be performed at a difficult-access work site, such as the site of FIG. 1.

FIG. 2 first illustrates on the top-right portion of the figure a tower site 202 where an operator of the site plans to install a tower. For instance, this tower site may comprise one site of multiple tower sites that will collectively comprise a series of towers carrying power lines or the like. Tower site 202 may comprise one or more tower leg locations 204(1), 204(2), . . . 204(N). Here, for instance, tower site 202 comprises four tower leg locations, each of which correspond to a leg of a lattice tower to be installed at tower site 202.

At each tower leg location 204(1)-(N) an operator of tower site 202 may first excavate one or more shafts to make way for a corresponding number of piles. For instance, the operator may install a radial array of micropiles at each tower leg location 204(1)-(N). In these instances, FIG. 2 illustrates that each of the tower leg locations may comprise a common target location 206(1) designating a location 208(1) of a pile group to be installed. Stated otherwise, pile group location 208(1) comprises a location where the operator plans to excavate the shafts and install the piles (shown in broken lines). In instances where the piles to be installed comprise a radial array of piles having a predetermined array diameter ($D_A$), common target location 206(1) comprises a center point of this array diameter.

With this illustration in mind, process 200 begins at operation 210, which represents locating common target location 206(1) for one pile group location 208(1). After locating common target location 206(1), an operator of the site may transport (e.g., via helicopter, crane, truck or the like) a platform base 212 to tower site 202. Platform base 212 generally comprises multiple (e.g., four) adjustable legs extending downward from respective corners of a platform. Additionally, platform base 212 further comprises a large, substantially circular opening for receiving a portion of the rotating drill assembly, described below. Of course, while the described implementation includes circular members, each component of rotating drill assembly 108 may comprise any shape or form in other implementations.

Process 200 continues at operation 214, which represents positioning platform base 212 over common target location 206(1). The operator may utilize the helicopter, crane or the like to position a center point 216 of platform base 212 over common target location 206(1). In addition, the operator may adjust the legs of platform base 212 to level the platform of platform base 212. That is, the operator may adjust the legs of platform base with the contour of the underlying ground in order to create a level surface on the top of platform base 212.

Figure 3:
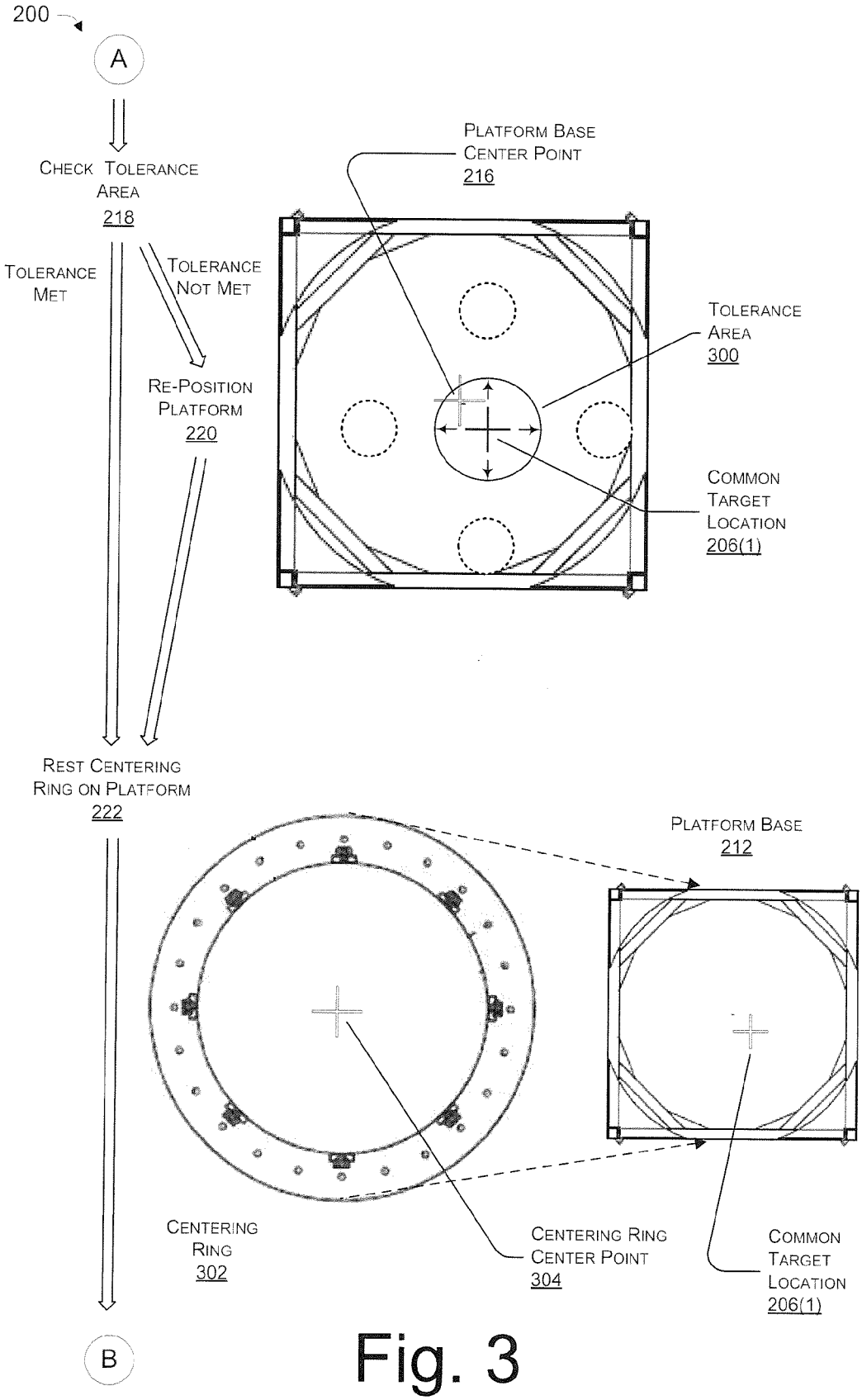

Process 200 continues with operation 218 at the upper right portion of FIG. 3. Operation 218 involves the operator checking that platform base center point 216 is located within a tolerance area 300 surrounding common target location 206 (1). For instance, tolerance area 300 may comprise a diameter of between two inches and two feet (or any other diameter), in which case the operator may determine whether or not center point 216 of platform base 212 is within this defined range.

If the operator determines during operation 218 that the tolerance is not met (i.e. the platform base center point 216 is not within tolerance area 300), then the operator performs operation 220. Operation 220 instructs the operator to reposition platform base 212 so that platform base center point 216 is within tolerance area 300 and, therefore, so that the tolerance is met. With platform base center point 216 within tolerance area 300, platform base 212 provides a positioned first plane for the remaining portions of the drill to be properly assembled as described below. In some instances, this first plane comprises a flat and level plane upon which additional components of rotating drill assembly 108 may mount.

Process 200 continues with operation 222, illustrated at the lower-right portion of FIG. 3. Operation 222 describes resting a centering ring 302 (having a large, substantially circular opening) on platform base 212. In some instances, platform base 212 comprises a recessed socket for receiving centering ring 302. That is, platform base 212 comprises an area that is designed to securely receive centering ring 302 that is located near the outer perimeter of platform base 212. In some instances, this socket includes a float distance in which the operator may adjust the position of centering ring 302 within the socket of platform base 212. In addition, a portion of the opening of platform base 212 resides beneath the opening of centering ring 302, both of which may receive a portion of a drill as described below.

When resting centering ring 302 on platform base 212, the operator may utilize a helicopter, crane or any other similar or different transportation mechanism. As described above, platform base 212 has been positioned over common target location 206(1) such that platform base center point 216 is within tolerance area 300. This allows the operator to rest centering ring 302 on platform base 212 such that a center point 304 of centering ring 302 is also within tolerance area 300 and, therefore, resides over common target location 206 (1) within the predefined tolerance.

Figure 4:
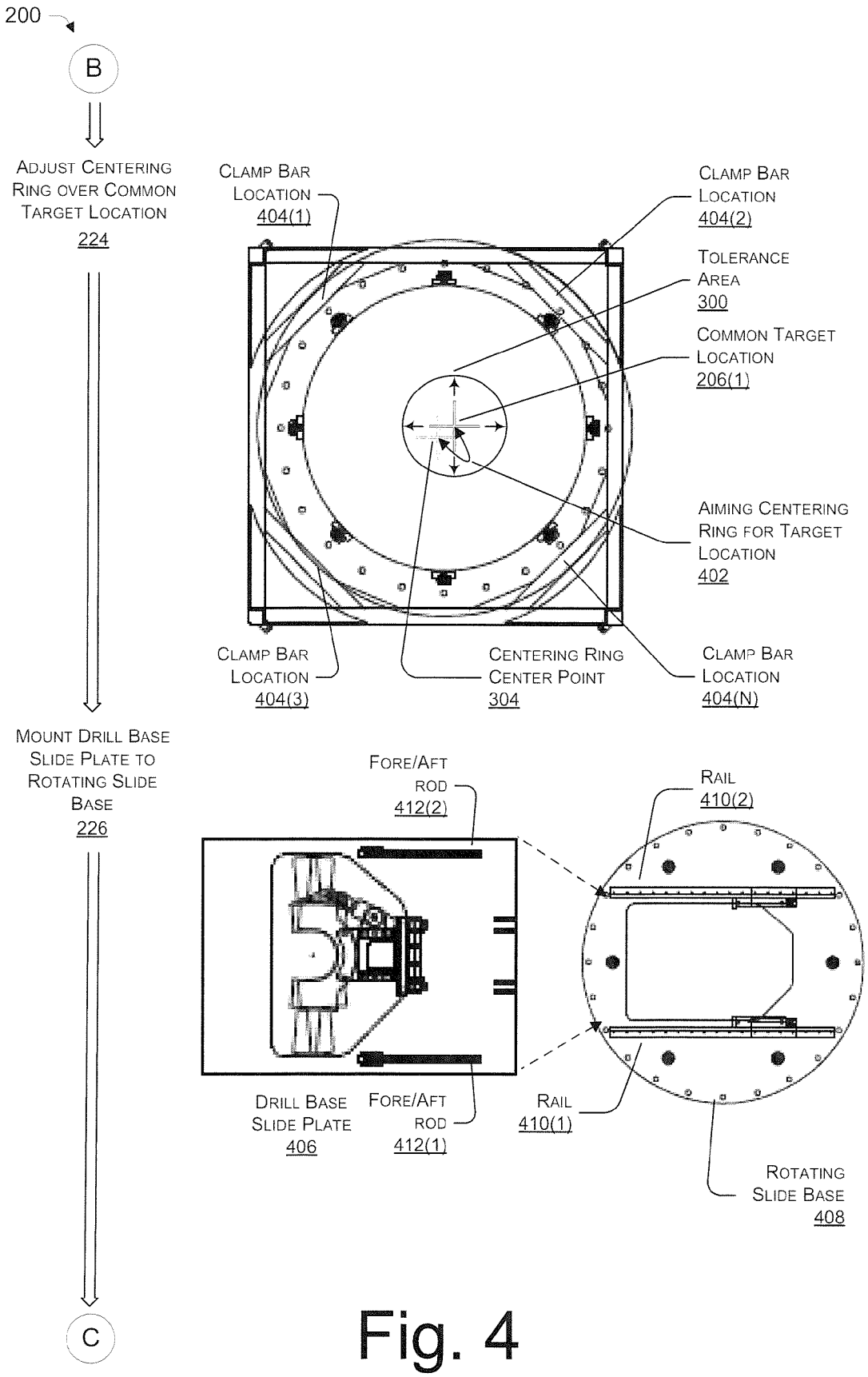

After the operator has performed operation 222, process 200 continues at FIG. 4 with operation 224. Operation 224 represents adjusting centering ring 302 over common target location 206(1) on platform base 212 to more closely align center point 304 of centering ring 302 with common target location 206(1). With centering ring 302 resting on platform base 212, centering ring 302 defines a second plane that is parallel or substantially parallel to the first plane. As such, the operator is free to adjust centering ring 302 on platform base 212 in any direction within the second plane. Again, this adjustability allows the operator to aim centering ring 302 towards target location 206(1), as arrow 402 illustrates.

With the centering ring 302 properly adjusted such that centering-ring center point 304 is in-line with common target location 206(1) (i.e., is directly over target location 206(1)), the operator may choose to securely fix centering ring 302 to platform base 212. While the operator may choose to securely fix centering ring 302 in the adjusted position in any number of ways, FIG. 4 illustrates that the operator may do so with one or more clamp bars at clamp bar locations 404(1), 404(2), . . . , 404(N).

Process 200 continues with operation 226, illustrated at the lower-right portion of FIG. 4. Operation 226 shows that a drill base slide plate 406 may mount to a rotating slide base 408 via rail 410(1) and rail 410(2). Here, drill base slide plate 406 is shown with fore/aft adjust cylinder rod 412(1) and fore/aft adjust cylinder rod 412(2). Fore/aft adjust cylinder rods 412 (1) and 412(2) connect to rotating slide base 408 and provide means for linearly moving drill base slide plate 406 along rails 410(1) and 410(2) in either a fore direction or aft direction, as described below in greater detail. Stated otherwise, when drill base slide plate 406 mounts to rotating slide base 408 (and after complete assembly of rotating drill assembly 108), an operator of the drill may linearly adjust drill base slide plate 406 along rotating slide base 408.

In addition and as illustrated, both drill base slide plate 406 and rotating slide base 408 may also comprise respective large openings disposed in the middle of these components. When rotating slide base 408 (and drill base slide plate 406) mounts to centering ring 302, as described immediately below, the opening of rotating slide base 408 and drill base slide plate 406 may reside above the openings of centering ring 302 and platform base 212. Similar to these previously discussed openings, the openings of rotating slide base 408 and drill base slide plate 406 may receive a portion of a drill, as discussed below.

While process 200 describes mounting drill base slide plate 406 to rotating slide base 408 after adjusting centering ring 302 over common target location 206(1), in some instances drill base slide plate 406 may be mounted to rotating slide base 408 at any other sequence location of process 200. Furthermore, in other instances, drill base slide plate 406 may be integral with rotating slide base 408.

Figure 5:
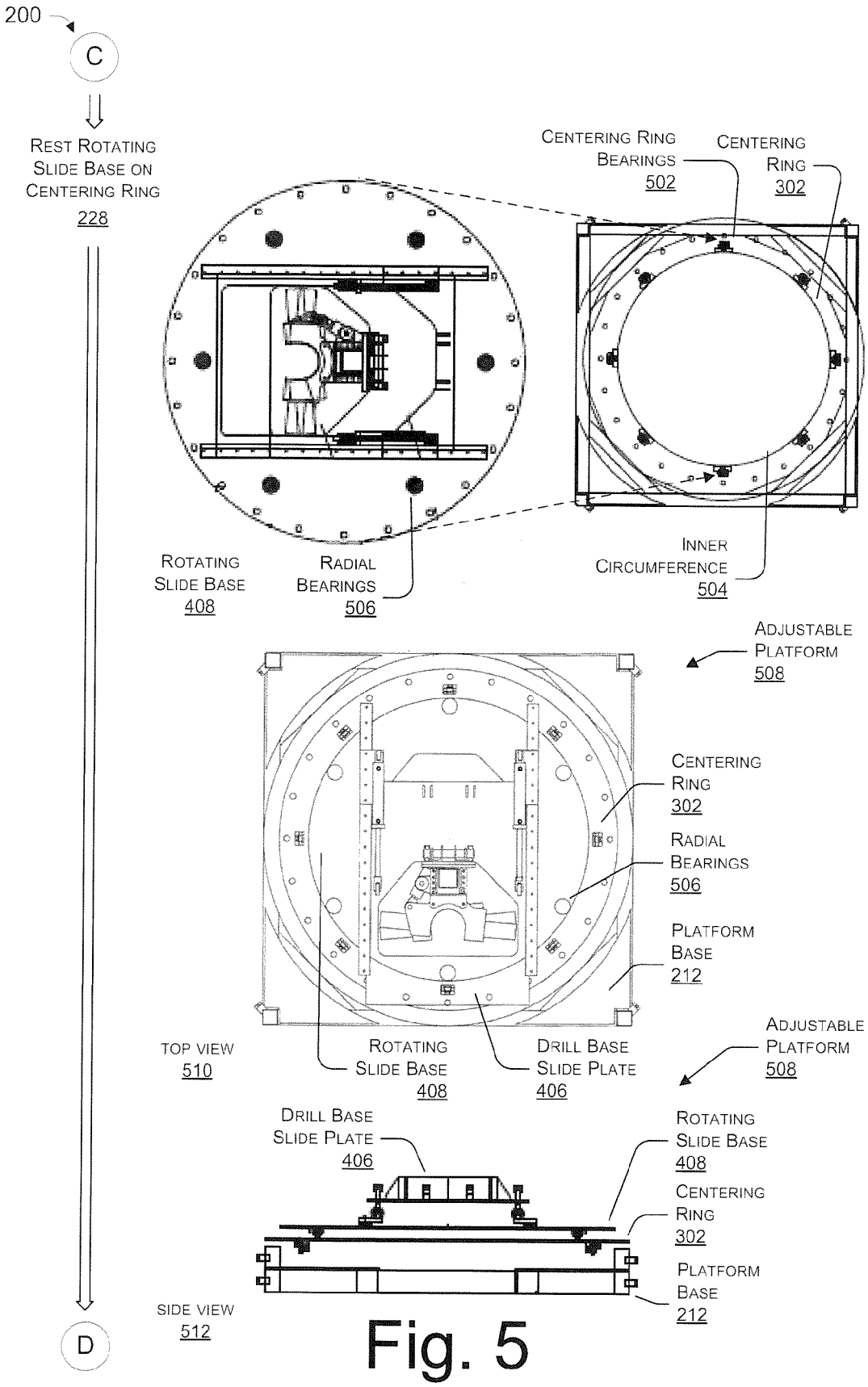

The upper right-hand portion of FIG. 5 continues process 200 at operation 228. Operation 228 represents resting rotating slide base 408 on centering ring 302 in a third plane that is substantially parallel to the first and second planes described above. Again, the operator of the work site may rest this component on centering ring 302 via a helicopter, crane or in any other suitable manner. In some implementations, one or more bearings may reside in between rotating slide base 408 and centering ring 302. For instance, one or both of rotating slide base 408 and centering ring 302 may include one or more bearings, such as one or more plain bearings, rolling element bearings, jewel bearings, fluid bearings, magnetic bearings, flexure bearings and the like.

Furthermore and as illustrated, these bearings may reside on an outer perimeter of rotating slide base 408 and/or centering ring 302. For instance, the bearings may reside two times closer, four times closer, etc. to an outer edge of the rotating slide base 408 or centering ring 302 than to a center point of these components.

In the illustrated embodiment, rotating slide base 408 rests on bearings 502 disposed on centering ring 302. Meanwhile, an inner circumference 504 of centering ring 302 provides a bearing surface for radial bearings 506 disposed on rotating slide base 408. As such, rotating slide base 408 securely attaches both axially and radially to centering ring 302. In addition, with use of centering-ring bearings 502 and radial bearings 506, rotating slide base 408 is configured to rotate 360 degrees in a clockwise and counter-clockwise direction on centering ring 302 and about a center point of rotating slide base 408. In addition, because rotating slide base 408 mates directly on top of centering ring 302, rotating slide base 408 also rotates about center point 304 of centering ring 302 and, hence, about common target location 206(1).

While process 200 describes resting rotating slide base 408 with drill base slide plate 406 on centering ring 302 at operation 228, other implementations rest rotating slide base 408 on centering ring 302 followed by mounting drill base slide plate 406 to rotating slide base 408.

After resting rotating slide base 408 on centering ring 302, an adjustable platform 508 configured to hold a drill and a motor has been defined and assembled. A top view 510 of this adjustable platform and a side view 512 of adjustable platform 508 are shown respectively in the middle and lower right-hand portions of FIG. 5.

Figure 6:
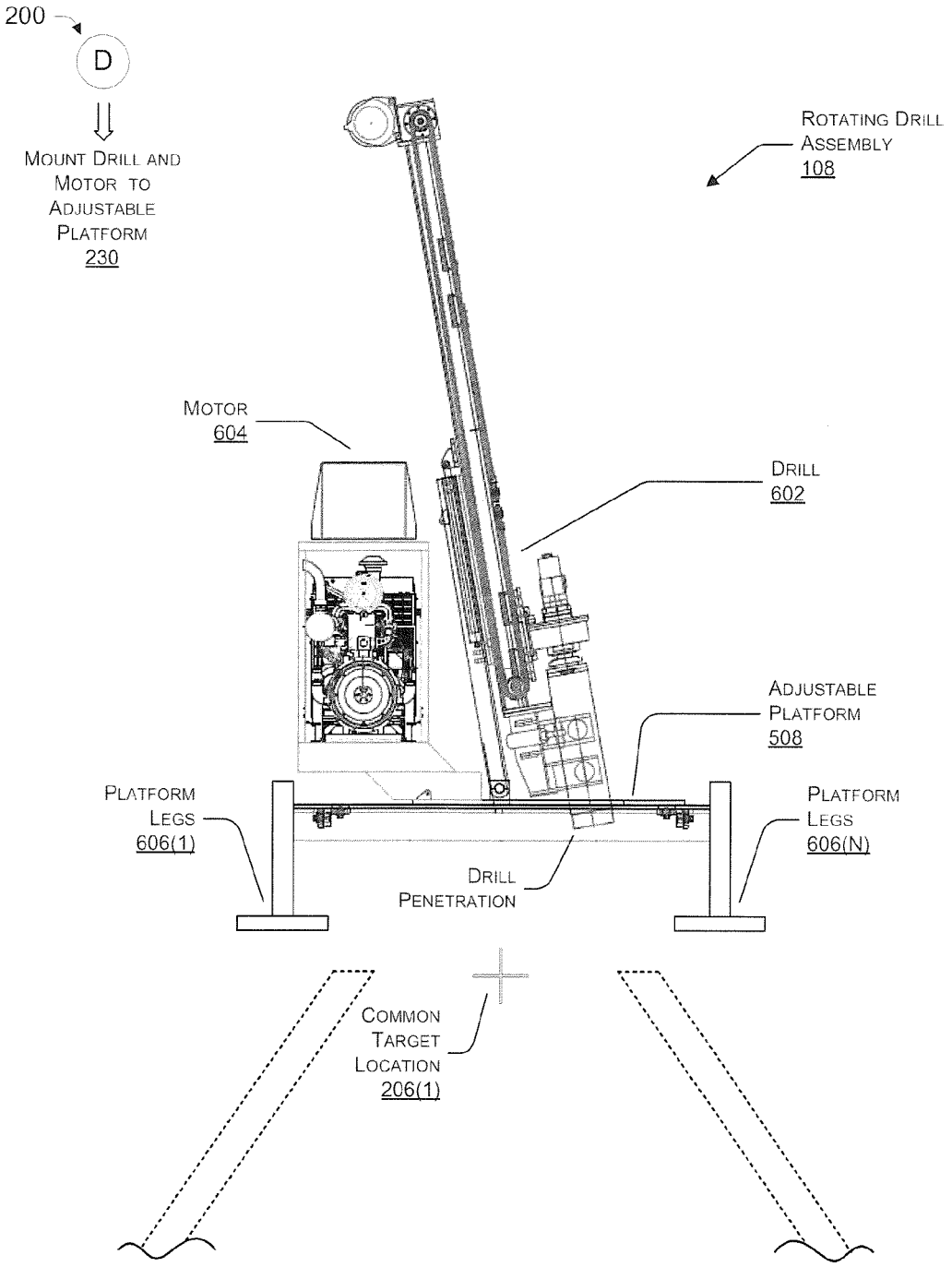

Finally, operation 230 completes process 200 at FIG. 6. As illustrated, operation 230 represents mounting a drill 602 and a motor 604 to adjustable platform 508. Again, the operator may employ a crane, helicopter or the like to position drill 602 and motor 604 on adjustable platform 508. One or more platform legs 606(1), . . . , 606(N) (discussed above at operation 214) position drill 602, motor 604 and adjustable platform 508 over common target location 206(1). Taken together, drill 602, motor 604 and adjustable platform 508 may define rotating drill assembly 108 illustrated in and described with reference to FIG. 1. As discussed both above and below, the operator of the work site (e.g., difficult-access work site 100) may employ rotating drill assembly 108 to excavate one or more shafts around common target location 206(1) to install, for example, a radial array of batter-angled micropiles ("battered micropiles").

As described more fully below, the operator may operate rotating drill assembly 108 by rotating adjustable platform 508, securing the platform in place and operating drill 602. Because each component of adjustable platform 508 includes an opening in the middle of the respective component, drill 602 may enter through the collective opening in the middle of adjustable platform 508 and into the drilling surface, as FIG. 6 illustrates.

Example Rotating Drill Assembly Adjustments

Figure 7:
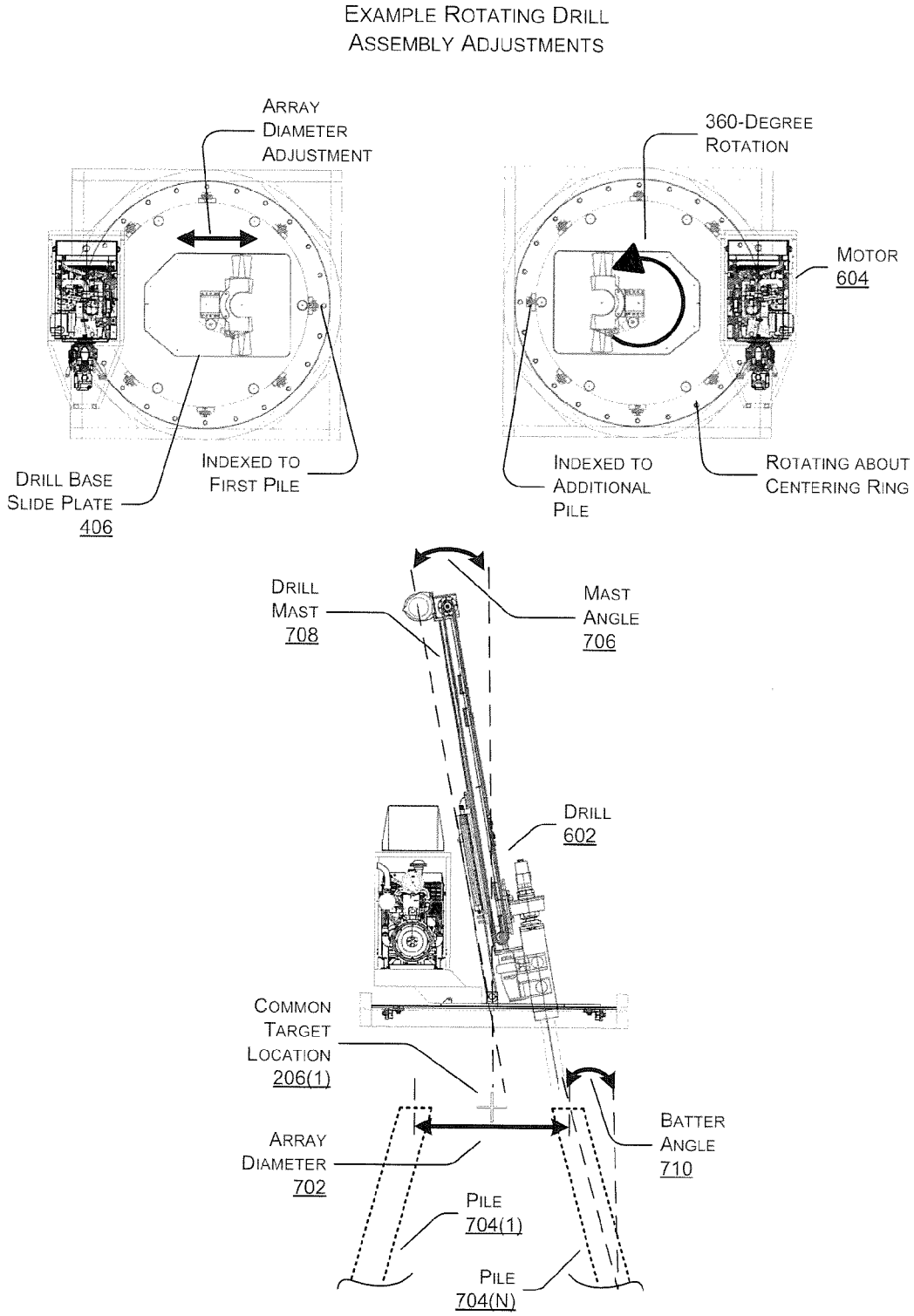
FIG. 7 illustrates example ways in which an operator of a rotating drill assembly may adjust the drill for the purpose of excavating shafts according to a pile design. Here, an operator may slide, rotate and alter an entry angle of the drill.

FIGS. 7-10 collectively illustrate example ways in which an operator of difficult-access rotating drill assembly 108 may adjust the drill for the purpose of excavating shafts according to a pile design. First, FIG. 7 illustrates, at a high level, rotating drill assembly 108 adjusting in multiple different manners. Each of FIGS. 8-10 proceeds to illustrate these adjustments in more detail. For clarity of illustration, portions of FIGS. 7-9 do not illustrate drill 602 as a part of rotating drill assembly 108. By adjusting rotating drill assembly 108 in each of the manners discussed in detail below, assembly 108 allows an operator to create a radial array of piles having characteristics (e.g., diameter, batter angle, elevation of piles above grade, etc.) specified by a pile design.

The upper-left portion of FIG. 7 represents linearly adjusting drill 602 and motor 604 on drill base slide plate 406. The drill and motor may slide backwards or forwards along rails 410(1) and 410(2) via drill base slide plate 406 and fore/aft rods 412(1) and 412(2). As described in greater detail in FIG. 8, this slide adjustment allows the operator to slide the drill to a position that matches an array diameter 702 of piles 704(1), . . . , 704(N) (shown in lower portion of FIG. 7).

Figure 9:
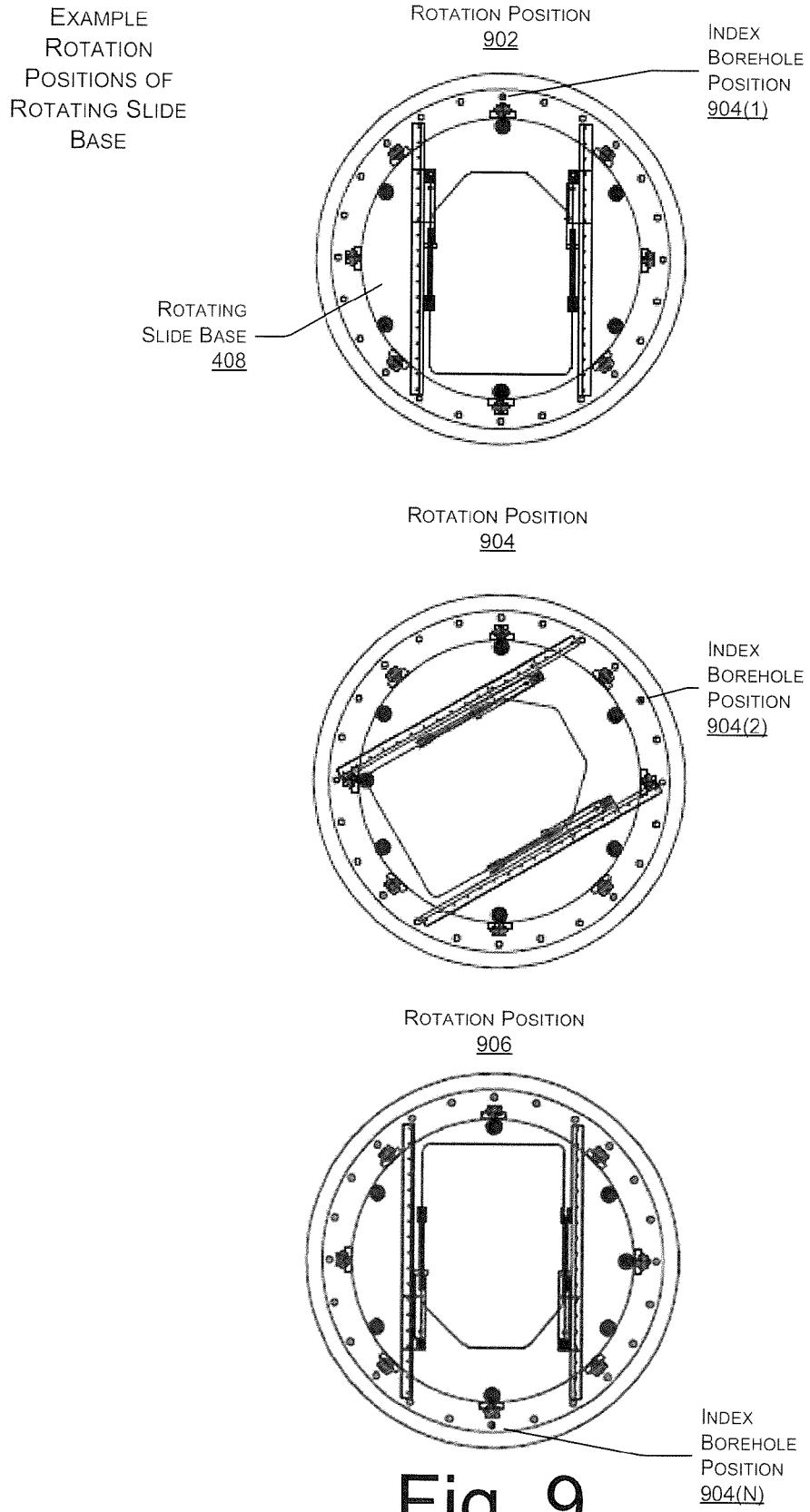
FIG. 9 illustrates example rotation positions of a rotating slide base upon which the drill mounts. An operator of the drill assembly may rotate the rotating slide base and mounted drill to each position associated with a shaft to be excavated according to the pile design.

Next, the upper-right portion of FIG. 7 represents a drill and motor rotation adjustment. As described above, drill 602 and motor 604 may rotate 360 degrees in a clockwise or counter-clockwise direction via rotating slide base 408 and the bearings disposed beneath base 408. This 360-degree rotation allows the operator to index the drill to multiple different index positions about common target location 206 (1). More specifically, the upper-right portion of FIG. 7 shows a counter-clockwise rotation about fixed centering ring 302 such that drill 602 and motor 604 are indexed to a different pile position than the first pile position illustrated in the upper-left portion of FIG. 7. FIG. 9 describes this rotation adjustment in greater detail.

Finally, the lower portion of FIG. 7 represents adjusting an angle 706 of a mast 708 of drill 602. An operator may adjust mast 708 such that mast angle 706 matches a designed batter angle 710 of piles 704(1), . . . , 704(N). After having linearly and rotationally adjusted drill 602, and after having adjusted mast angle 706 of drill mast 708, the operator has positioned drill 602 to excavate pile 704(N) according to the predetermined pile design. It is to be appreciated, however, that an operator of rotating drill assembly 108 may perform any of the adjustments illustrated in FIG. 7 in any order.

Figure 8:
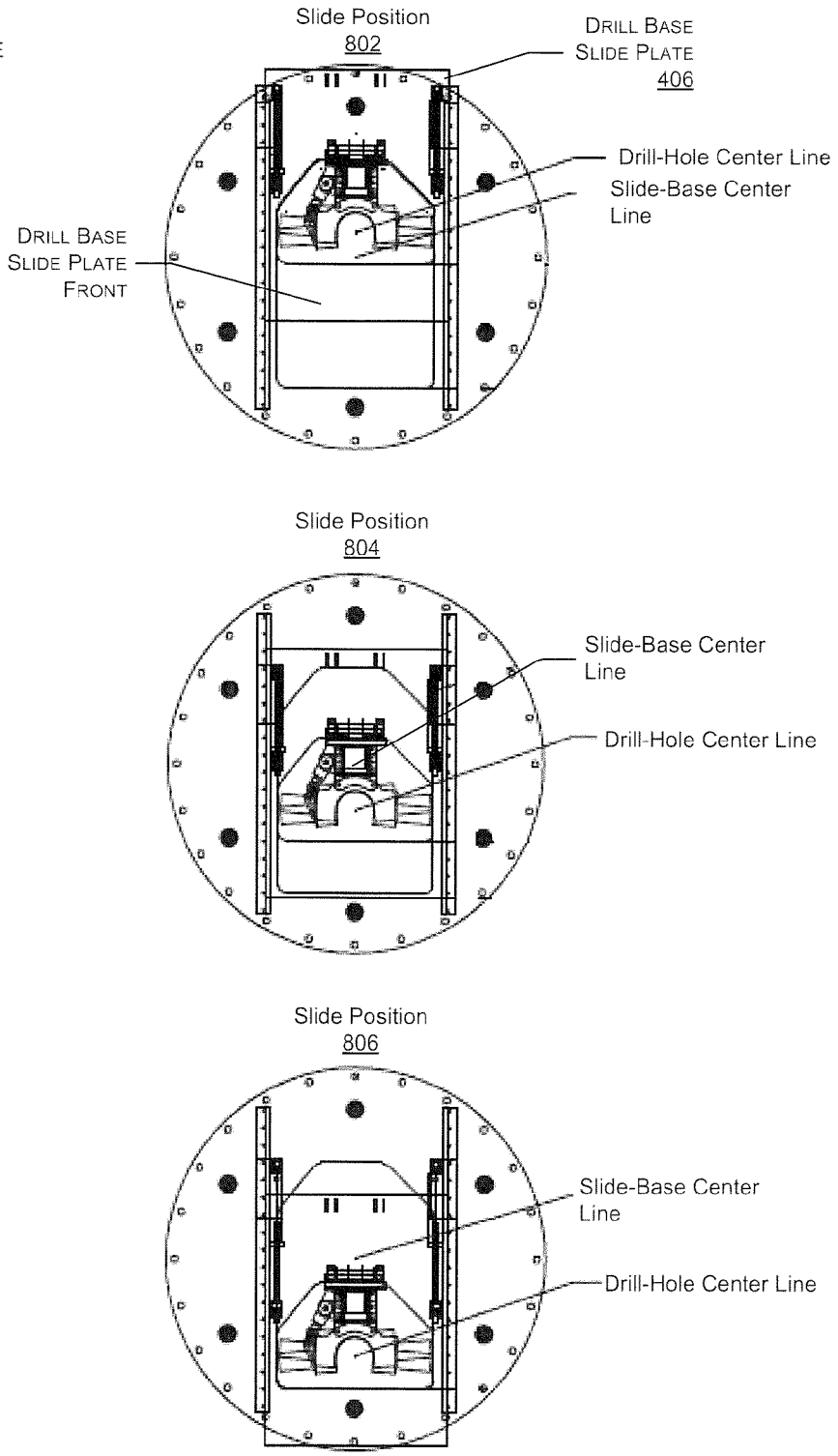
FIG. 8 illustrates example slide positions of a drill base slide plate upon which the drill mounts. An operator of the drill assembly may slide the drill base slide plate and mounted drill to excavate a radial array of shafts at a predetermined diameter of the pile design.

FIG. 8 illustrates linearly adjusting rotating drill assembly 108 in greater detail. Specifically, FIG. 8 illustrates three example slide positions 802, 804 and 806 of drill base slide plate 406 upon which drill 602 mounts. Typically, the operator of rotating drill assembly 108 may determine a predetermined array diameter of a pile design before sliding drill base slide plate 406 to a proper slide position (e.g., position 802, 804 or 806) to achieve this predetermined diameter.

In some instances, illustrated slide positions 802, 804 and 806 represent respective positions that an operator of the drill may employ to excavate a radial array of shafts at a predetermined diameter of a pile design. First, slide position 802 illustrates that a drill-hole center line resides behind a slide base center line. As such, slide position 802 represents a position where a portion of drill 602 penetrates adjustable platform 508 behind the slide base center line. Further, slide position 802 allows the drill to penetrate the platform behind center point 304 of centering ring 302, which aligns with common target location 206(1) as discussed above. By positioning drill base slide plate 406 in this manner, the operator is able to excavate a radial array of shafts at a relatively tight diameter of a pile design.

As mentioned above, centering-ring bearings 502 that are disposed along a perimeter of centering ring 302 and radial bearings 506 that are disposed along a perimeter of rotating slide base 408 enable slide position 802. That is, because both the bearings 502 and bearings 506 reside at an outer perimeter of adjustable platform 508 (rather than in a middle or center point of the platform), the adjustable platform provides an opening in the middle of the platform to receive a portion of drill 602. This opening at the center of the adjustable platform allows drill 602 to penetrate adjustable platform 508 in any of slide positions 802, 804 or 806 or in any other of a multitude of positions.

Slide positions 804 and 806, meanwhile, represent slide positions where the drill-hole center line resides in front of the slide-base center line. As such, an operator may use these slide positions to achieve respective array diameters that are greater than the array diameter achieved via slide position 802.

FIG. 9 illustrates example rotation positions 902, 904 and 906 of rotating slide base 408 upon which drill base slide plate 406 and drill 602 mounts. By allowing an operator of rotating drill assembly 108 to rotate the assembly in this manner, the operator is able to excavate the number of shafts and install the number of piles called for by a pile design. For instance, if the pile design calls for a radial array of four piles, then the operator may rotate and position rotating slide base 408 to each of the four pile locations to excavate a shaft and install a pile at each location. In the illustrated example, for instance, the operator may excavate a first shaft and install a pile at position 902, may excavate a second shaft and install a second pile at position 904 and may excavate yet another shaft and install yet another pile at position 906.

In order to secure rotating slide base 408 at a particular rotation position, adjustable platform 508 may include one or more index boreholes 908(1), 908(2), . . . , 908(N). As illustrated, index boreholes 908(1)-(N) are located near the outer perimeter of centering ring 302 and rotating slide base 408. In some instances, index boreholes 908(1)-(N) reside within both centering ring 302 and rotating slide base 408. As such, an operator may rotate rotating slide base 408 and mounted drill 602 to any index borehole locations relative to fixed centering ring 302 and may fasten rotating slide base 408 by inserting a pin or the like into one or more of index boreholes 908(1)-(N). While FIG. 9 illustrates securing rotating slide base 408 via pins inserted into one or more of boreholes 908(1)-(N), other implementations may secure rotating slide base 408 at different positions in array of other suitable manners (e.g., via clamps, notches, etc.).

In some instances, adjustable platform 508 may be designed to allow an operator to excavate a quantity of evenly-distributed array of shafts, with the quantity being a divisor or a multiple of 24. For instance, adjustable platform 508 may be designed to allow an operator to excavate an evenly-distributed array of shafts in the following quantities: 2, 3, 4, 6, 8, 12, 24, 48 etc. To do so, rotating slide base 408 may comprise 24 index boreholes 908(1)-(N).

Figure 10:
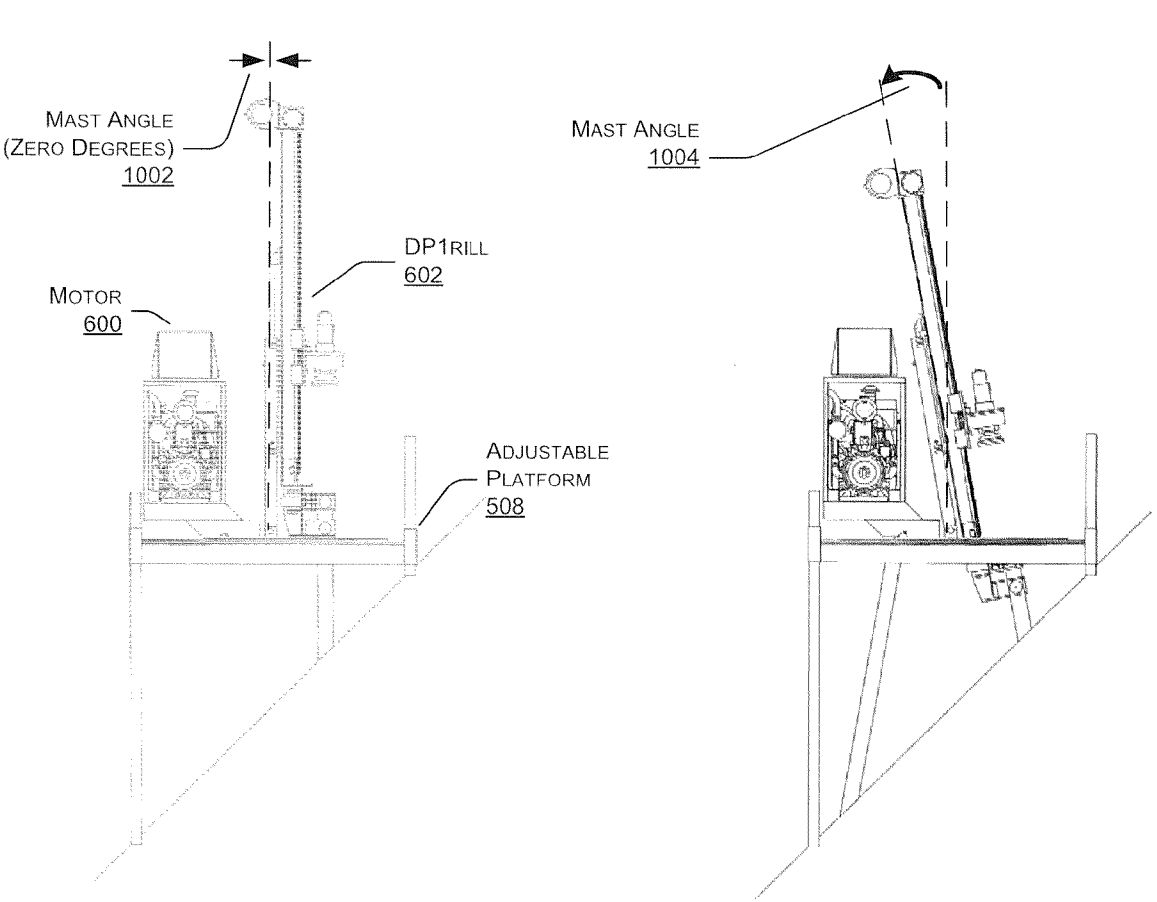
FIG. 10 illustrates example entry angle positions of the drill of the rotating drill assembly. An operator of the drill assembly may alter the entry angle of the drill to match a predetermined batter angle, as specified by the pile design.
Figure 11:
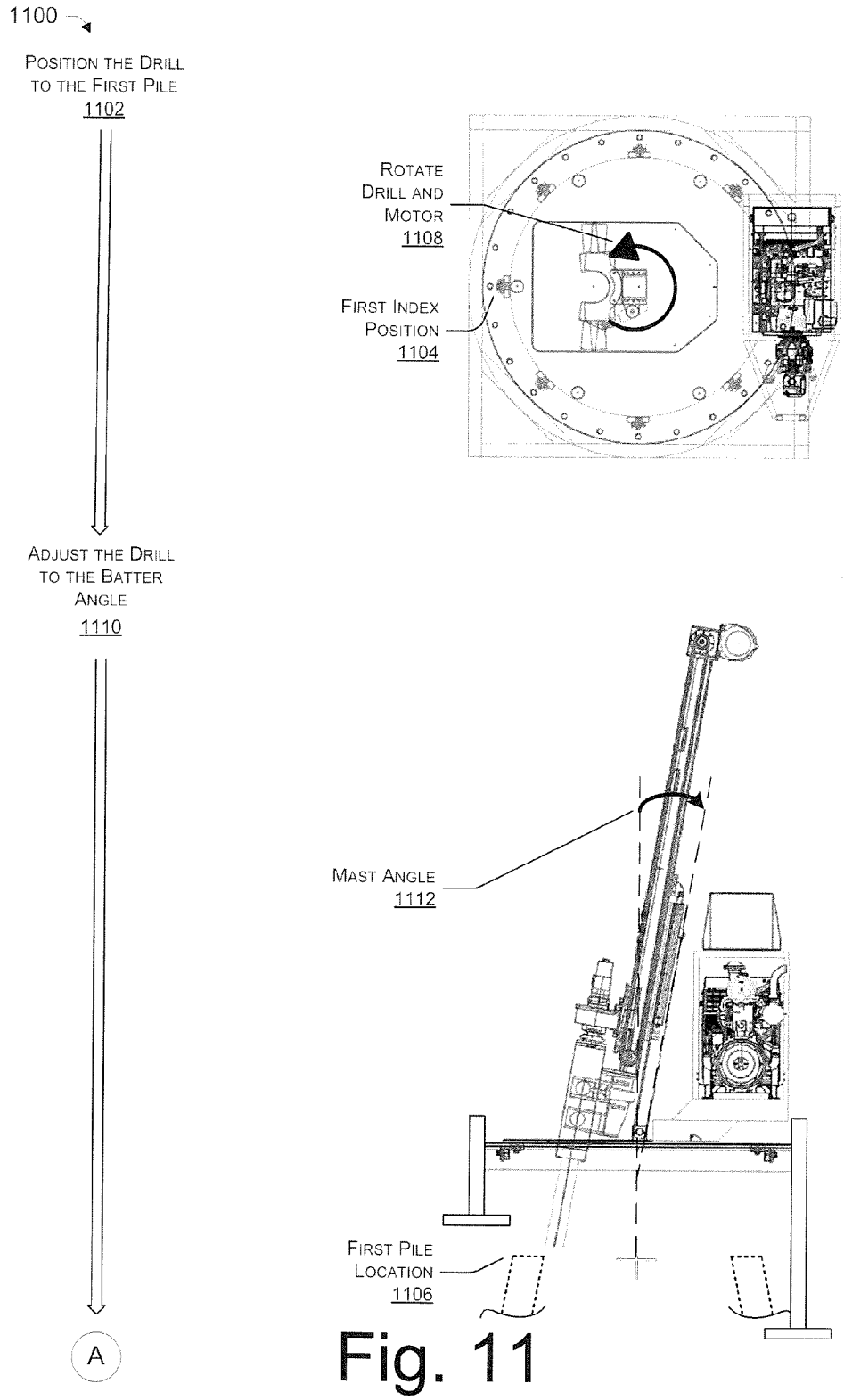
FIGS. 11-15 illustrate an example process for architecting a custom pile design based at least in part on geotechnical characteristics of a particular excavation site. For instance, an operator may perform this process to determine a number of piles to include in the design, a length of a casing of the piles or a bond length of the piles. In some instances, the operator may perform this process at the excavation site and just prior to excavating the shafts and installing the piles.

FIG. 10 illustrates example mast angle positions 1002 and 1004 of drill 602 of rotating drill assembly 108. As discussed above, an operator of rotating drill assembly 108 may alter the mast angle (i.e., the entry angle of the drill) to match a predetermined batter angle at which a radial array of piles are to be installed, as specified by the pile design. The left portion of FIG. 10 illustrates a mast angle position 1002 of zero degrees. At this position, the drill will excavate a substantially vertical shaft for a substantially vertical pile (i.e., a pile having no batter angle or a batter angle of zero degrees). The right side of FIG. 7, meanwhile, illustrates a mast angle position 1004 of some positive angle that is greater than zero but less than ninety degrees. Here, the drill will excavate a shaft according to this mast angle, resulting in a pile having a batter angle equal to the mast angle.

Example Process for Architecting Custom Structure Designs

FIGS. 11-15 illustrate an example process 1100 for architecting a custom pile design based at least in part on geotechnical characteristics of a particular excavation site, such as difficult-access work site 100, as well as on load requirements of the structure to be attached to the resulting pile. For instance, an operator may perform this process to determine a number of piles to include in the design, a length of a casing of the piles a bond length of the piles or any other aspect of the pile design. In some instances, the operator may perform this process at the excavation site and just prior to excavating the shafts and installing the piles. While FIGS. 11-15 illustrate a process for architecting a pile design, it is to be appreciated that this process may apply to architecting designs of any type of structural members (e.g., rock anchors, micropiles, substitute piles, replacement piles, etc.).

Process 1100 includes an operation 1102, which represents positioning drill 602 to a first index position 1104 associated with a location 1106 of a first pile to be installed at an example tower site. As arrow 1108 represents, an operator may rotate and secure rotating slide base 408 and drill 602 to first index position 1104. Next, process 1100 proceeds to operation 1110, which represents an operator adjusting drill 602 to a mast angle 1112. In some instances, mast angle 1112 matches a predetermined batter angle for the first pile.

Figure 12:
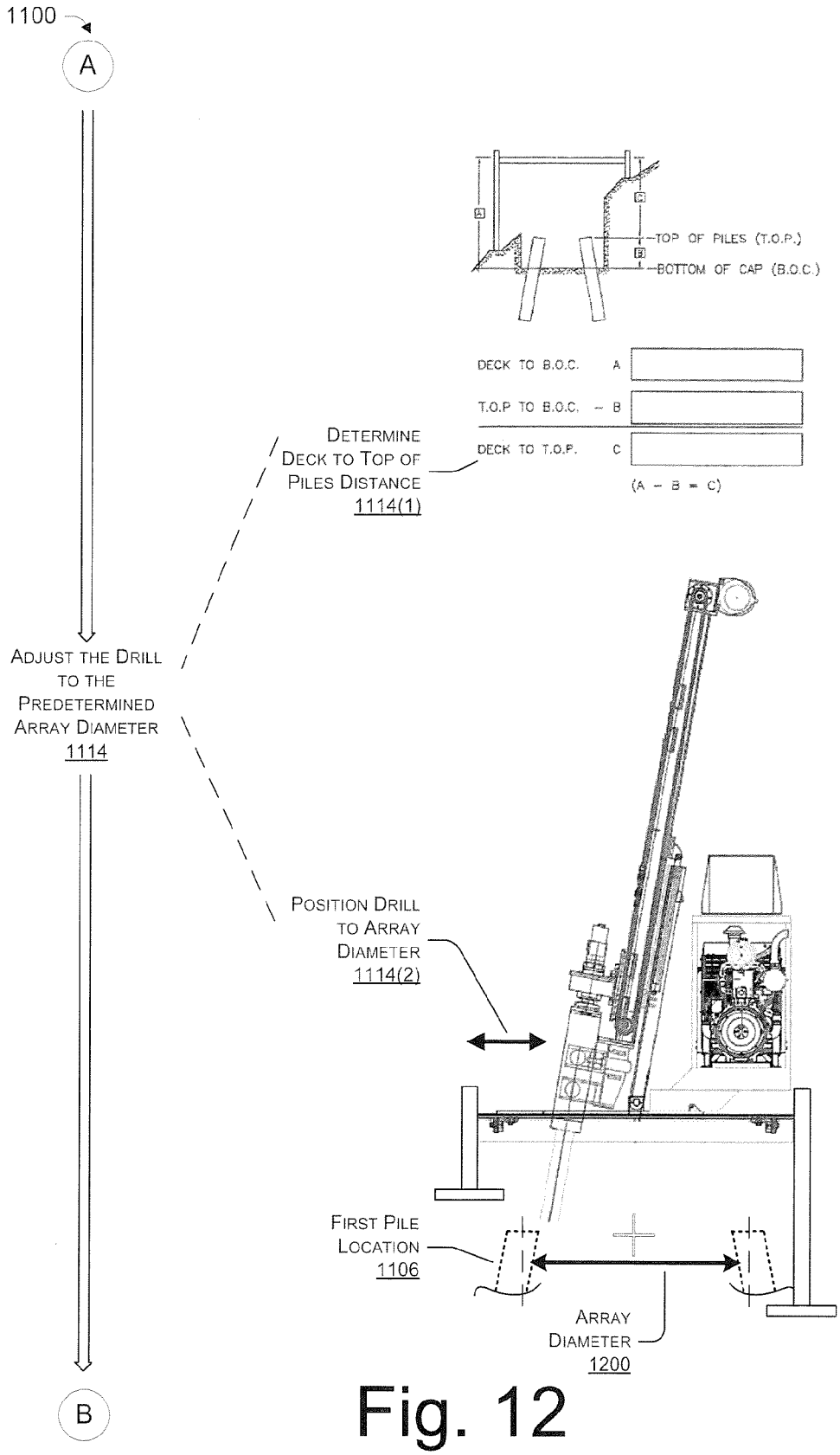

FIG. 12 continues the illustration of process 1100 and includes an operation 1114, which comprises two sub-operations 1114(1) and 1114(2). Here, the operator may adjust drill base slide plate 406 to match a predetermined diameter 1200 of the radial array of piles to be installed.

At sub-operation 1114(1), an operator may determine a distance between a desired top of the radial array of piles and platform base 212 (i.e., the "deck"). To do so, the operator may first measure a distance between platform base 212 and a bottom of an excavation, upon which a bottom of a cement structural cap may sit after completion of the piles in implementations that employ such a cap. Next, the operator may measure a distance between the desired top of the radial array of piles and the bottom of the excavation. Finally, the operator may subtract the latter measured distance from the former measured distance to determine the distance between the desired top of the radial array of piles and the platform base 212.

With this distance information, along with the predetermined array diameter and batter angle, the operator may determine (e.g., mathematically or with reference to a chart) a linear location at which to station drill base slide plate 406 and drill 602 to achieve this diameter. After determining this linear location, the operator may proceed to position drill base slide plate 406 and drill 602 accordingly at sub-operation 1114(2). At this point, drill 602 of rotating drill assembly 108 points towards desired location 1106 of a first pile.

Figure 13:
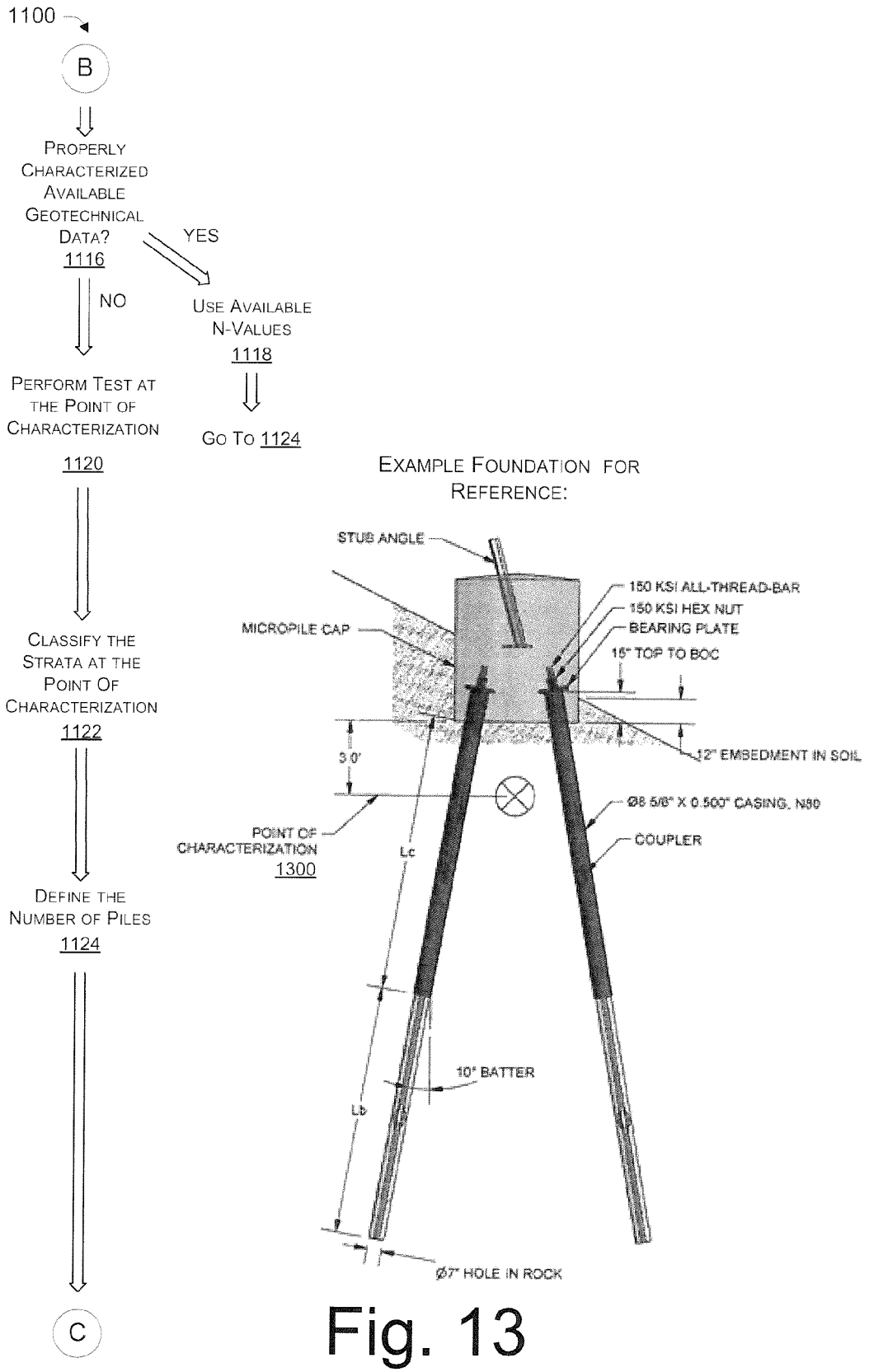

FIG. 13 continues the illustration of process 1100 and includes, at operation 1116, determining if properly-characterized geotechnical data for the first pile location (or for the site generally) is available. In some instances, this geotechnical data is described in terms of "N-values." If this properly-characterized data is available, then process 1100 proceed to use the available N-values at operation 1118 to determine aspects of the pile design, as described in detail below. In addition, the process proceeds to an operation 1124, also described below.

If, however, no available geotechnical data for the site exists, or if the available geotechnical data is determined to be improperly characterized for any reason, then process 1100 proceeds to operation 1120. Here, an operator may perform an in-situ (on-site) penetration test at a point of characterization 1300 to determine a geotechnical characteristic in the location 1106 associated with the first pile. This in-situ penetration test may comprise a Standard Penetration test (SPT) (as illustrated), a Cone Penetration Test (CPT), a penetration test that employs sound waves or any other similar or different test. Note that to perform this in-situ penetration test, the operator may employ rotating drill assembly 108, which has been properly set up to excavate first pile location 1106, as discussed above.

Point of characterization 1300, meanwhile, comprises a specified distance below ground. For instance, point of characterization 1300 may be, in some instances, more than one foot but less than six feet, or may comprise any other distance below ground. For instance, the operator may perform the in-situ penetration test at approximately three feet below ground measured from the bottom of the excavation.

After performing this penetration test at point of characterization 1300, the operator or another entity may classify, at operation 1122, the strata based on the results of the test. For instance, when the operator performs a Standard Penetration Test and determines a corresponding N-value (blows per foot) at the point of characterization, the operator may map this N-value to one of multiple defined soil conditions. For instance, the operator may determine whether this N-value corresponds to loose soil (e.g., $4<N<11$), medium dense soil (e.g., $12<N<39$), rock (e.g., $N>40$) or any other defined soil condition, possibly with reference to a decision matrix (an example of which is illustrated below in FIG. 16).

After classifying the strata at the point of characterization, the operator may define a number of piles to install at the pile group at operation 1124. For instance, after mapping an N-value associated with point of characterization 1300 to a defined soil condition for the tower site, the operator may consult the decision matrix that defines how many piles to install based on the soil condition, load conditions and possibly multiple other additional factors. For instance, the decision matrix may indicate that the operator should install eight piles for loose soil, six piles for medium dense soil and four piles for rocky conditions for a tower scheduled to be installed at the tower site. While a few example values have been listed, it is to be appreciated that these values are simply illustrative and that these values may vary based on the context of the application (e.g., load conditions, etc.).

Figure 14:
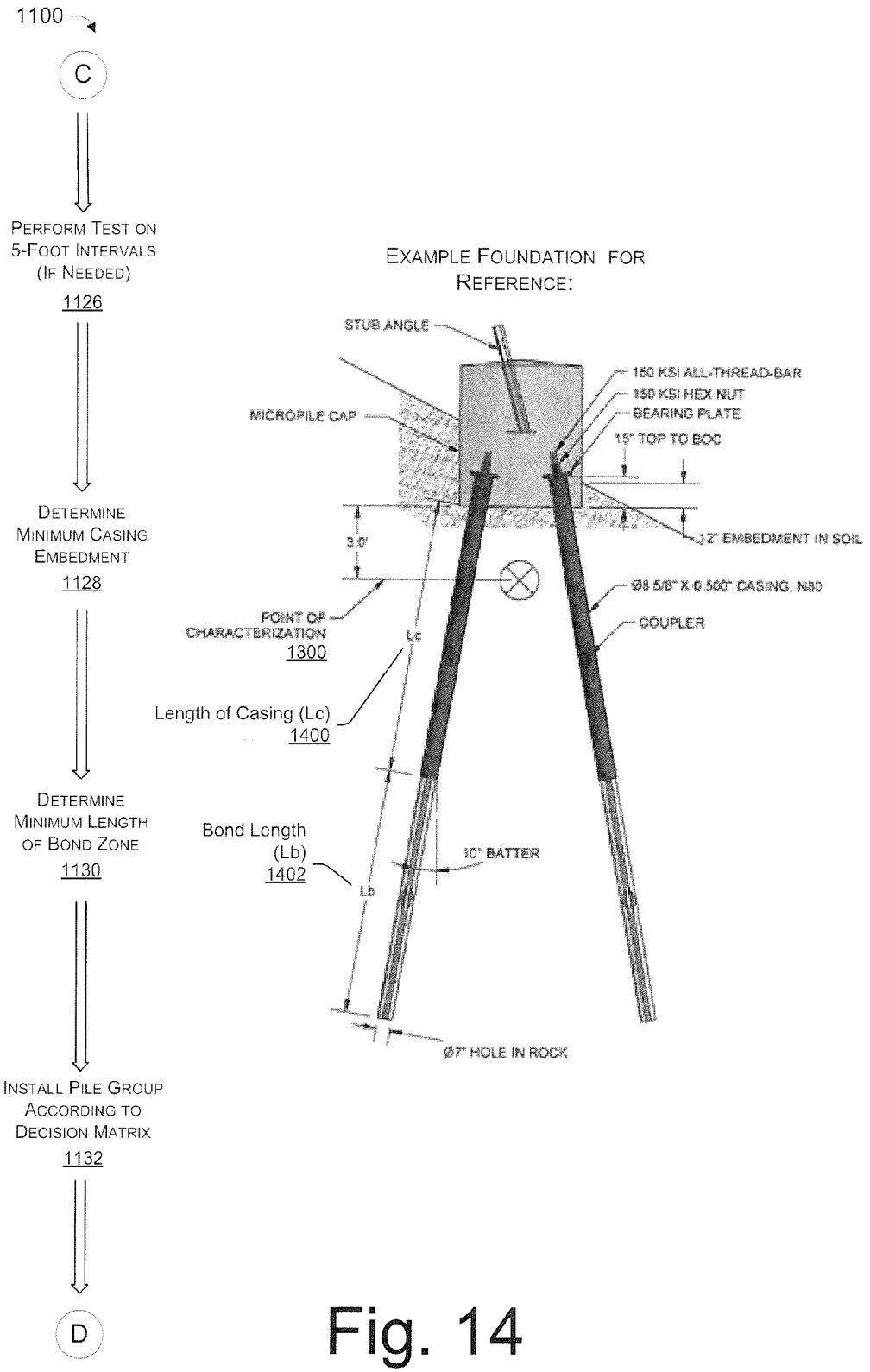

FIG. 14 continues the illustration of process 1100 and includes operation 1126, which represents performing an additional in-situ penetration test to determine a geotechnical characteristic at each of one or more intervals within first pile location 1106. In instances where properly-characterized geotechnical data is available (e.g., N-values), the operator may refrain from performing operation 1126 and may instead use the available data. Where properly-characterized data is not available however, the operator may perform the penetration tests at the specified intervals. For instance, the operator may perform these penetration tests at intervals of between two feet and ten feet. In one specific implementation, the operator performs the in-situ penetration test at five foot intervals until bedrock is reached or until a total depth of the pile (e.g., a total casing length plus a total bond length) is reached, as described below.

After determining a geotechnical characteristic (e.g., an N-value) at each interval, the operator may then use this information to determine a soil condition at each interval. With this information along with the previously-determined number of piles, the operator may consult the decision matrix mentioned above to determine a minimum casing embedment for the pile at operation 1128 based at least in part on determined soil conditions for the number of piles determined at operation 1124. The casing embedment may be defined, in some instances, as the length of permanent casing that extends beyond point of characterization 1300.

In the decision matrix, each type of soil condition at a tower site is associated with a minimum casing embedment for the determined number of piles. For instance, the decision matrix may state that for a four-pile group, the casing embedment length should be at least twelve feet for loose soil, ten feet for medium dense soil and nine feet for rock (see, for example, "Tower No. 29" in FIG. 16). For instance, envision that the operator has performed two in-situ penetration tests at five foot intervals below point of characterization 1300, and that each of these N-values indicates that the strata at each respective location comprises rock. Stated otherwise, these N-values indicate that the ten feet immediately below point of characterization 1300 comprises rock (assuming that no variation exists between the tested intervals). The minimum casing embedment in this instance would comprise nine feet and, as such, nine or more feet of casing would satisfy the decision matrix by meeting a minimum casing length requirement for one continuous soil condition.

In some instances, however, the upper strata may transition (e.g., between loose, medium dense, rock, etc.) before a minimum requirement is met for one continuous soil condition. If so, the decision matrix may require that the total length of the minimum casing embedment meet either or both of: (i) a minimum casing length for the weakest encountered soil condition in a combination of two or more soil of conditions, or (ii) a minimum casing length for a single soil condition.

For instance, returning to the four-pile-group example from above, envision that the operator determines (via interval testing) that the strata beneath point of characterization 1300 comprises eight feet of loose soil before transitioning to rock. As discussed above, the minimum required casing length for loose soil comprises twelve feet in this example, while the required casing length for rock comprises nine feet. Envision that the operator determines that rock continues past the eight feet of loose soil for four or more feet. Here, because loose soil comprises the weaker of the two soil conditions (loose soil and rock), the decision matrix determines that the minimum casing length for loose soil (twelve feet) has been satisfied by the twelve-foot combination of loose soil and rock.

In another instance, envision that the operator determines (via interval testing) that the strata beneath point of characterization 1300 comprises one foot of loose soil before transitioning to rock. Again, the minimum required casing length for loose soil comprises twelve feet, while the required casing length for rock comprises nine feet. Envision that the operator determines that rock continues past the one foot of loose soil for nine or more feet. Here, because the rock alone continues for at least the required nine feet, the decision matrix may determine that the rock satisfies the required minimum casing length. Here, the operator may install ten feet of casing, one foot of which will reside in loose soil and nine feet of which may reside in rock.

In addition, the operator may again consult the decision matrix to determine a minimum bond zone (i.e., a "minimum bond length") for the determined number of piles, at operation 1130. In some instances, the minimum bond length is defined to be the minimum required amount of bond length of a continuous bearing unit. Again, the determination of the minimum bond length may be made with reference to interval N-values and the soil conditions associated therewith.

In contrast to the minimum casing length, the bond zone must consist of the minimum required bond length of a single continuous soil condition in some instances. Therefore, if the strata transitions in the bond zone, the total length of the bond zone must be extended to include the minimum required length of one continuous unit.

In one example, the decision matrix may require, for a four-pile group, a minimum bond length of 23.5 feet for loose, sixteen feet for medium dense and ten feet for rock. For instance, envision that the operator determines from N-values associated the above-referenced interval testing, that the twenty feet of ground below the casing length comprises loose soil before transitioning to medium dense soil for another ten feet. Here, while the combination of the loose soil and the medium dense soil (thirty feet) would meet the requirement of loose soil (23.5 feet), the decision matrix is not satisfied because the strata does not comprise a continuous soil condition or unit. Instead, envision that the operator determines that the proceeding ten feet of strata comprises rock. Here, the operator may determine via the decision matrix that this ten feet of continuous rock satisfies the minimum bond zone. Therefore, the operator may install a pile having a bond length that extends forty feet past the end of the casing (twenty feet in soil+ten feet in medium dense soil+ten feet in rock).

After determining a number of piles to install in the group and determining a minimum casing embedment and bond length, the operator may install the group of piles at operation 1132. More specifically, the operator may install the defined number of piles, each having a length of casing 1400 and a bond length 1402 that are equal to or greater than their respective minimum values. In addition, the operator may utilize other parameters from the decision matrix (e.g., pile type, casing diameter, rebar diameter, etc.) to install this pile group at the tower site.

Figure 15:
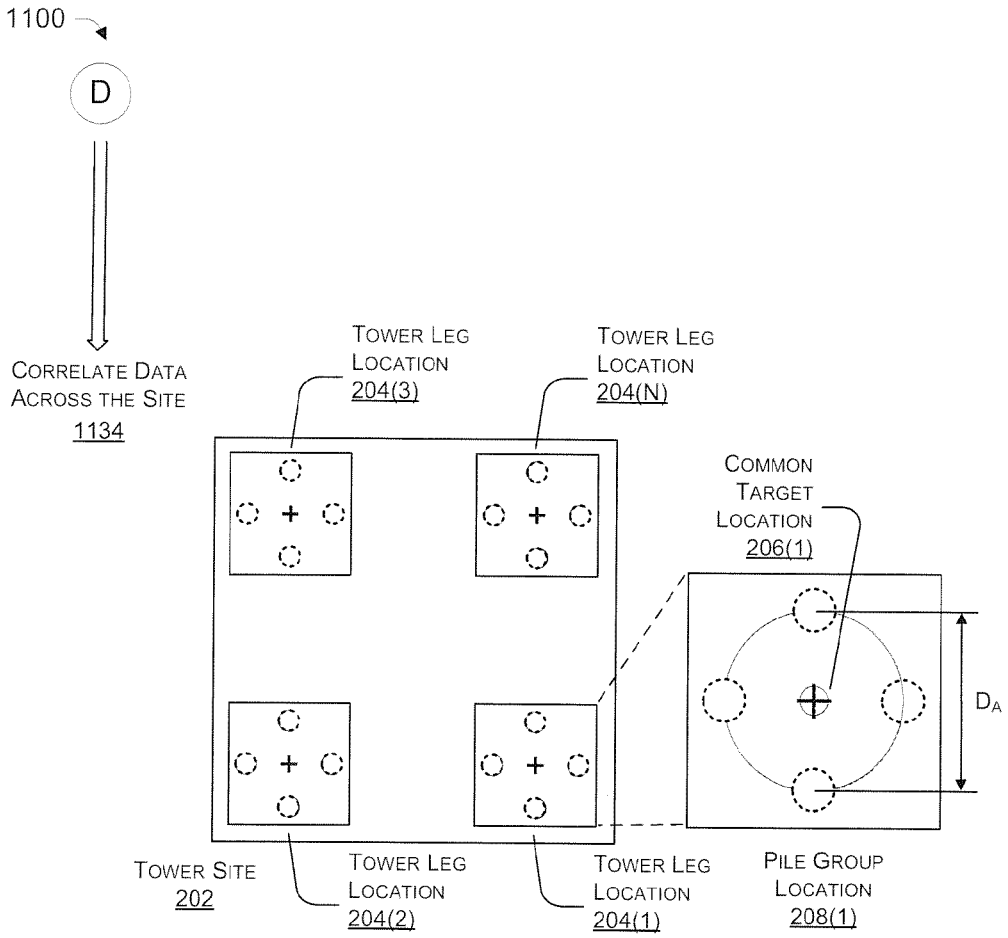

FIG. 15 concludes the illustration of process 1100 and includes, at operation 1134, correlating the determined data across the tower site or the entire work site. That is, the operator of the site may install, at each tower leg location and possibly at other tower leg locations for the tower site, the determined number of piles having the determined minimum casing embedment and bond length, so long as the geotechnical characteristics of these locations do not differ by more than a threshold amount from the first pile location.

If the geotechnical characteristics do differ by more than the threshold amount, then operations 1120 through 1132 may be repeated to determine a new quantity of piles, minimum casing embedment and/or bond length for these other piles. In other instances, the operator may repeat operations 1102 through 1132 for each pile, for each pile group, for each tower leg location or for each tower site, depending upon work site characteristics and other factors.

FIG. 16 illustrates an example foundation pile schedule 1600 for use with the example process 1100 described immediately above. While this schedule includes several example design parameters, it is to be appreciated that these parameters are merely illustrative and that the parameters may change based on work site factors, design considerations and the like.

Foundation pile schedule 1600 first illustrates details 1602 regarding a series of towers that are scheduled to be coupled to respective foundations. Foundation pile schedule 1600 also includes details 1604 regarding these foundations and a decision matrix for architecting the details of the foundation designs. Foundation details include, for instance, a projection of the pile group, various elevations of the pile group, an array diameter and batter angle of the pile group, as well as casing and rebar diameters. In addition, the details include a number of piles, a minimum casing embedment, a minimum bond length and a micropile type. Each of these latter details may be dependent upon tower details 1602, other pile design parameters and soil conditions at the point of characterization and below this point as described with reference to process 1100.

Example Structural Caps and Associated Process

Figure 17:
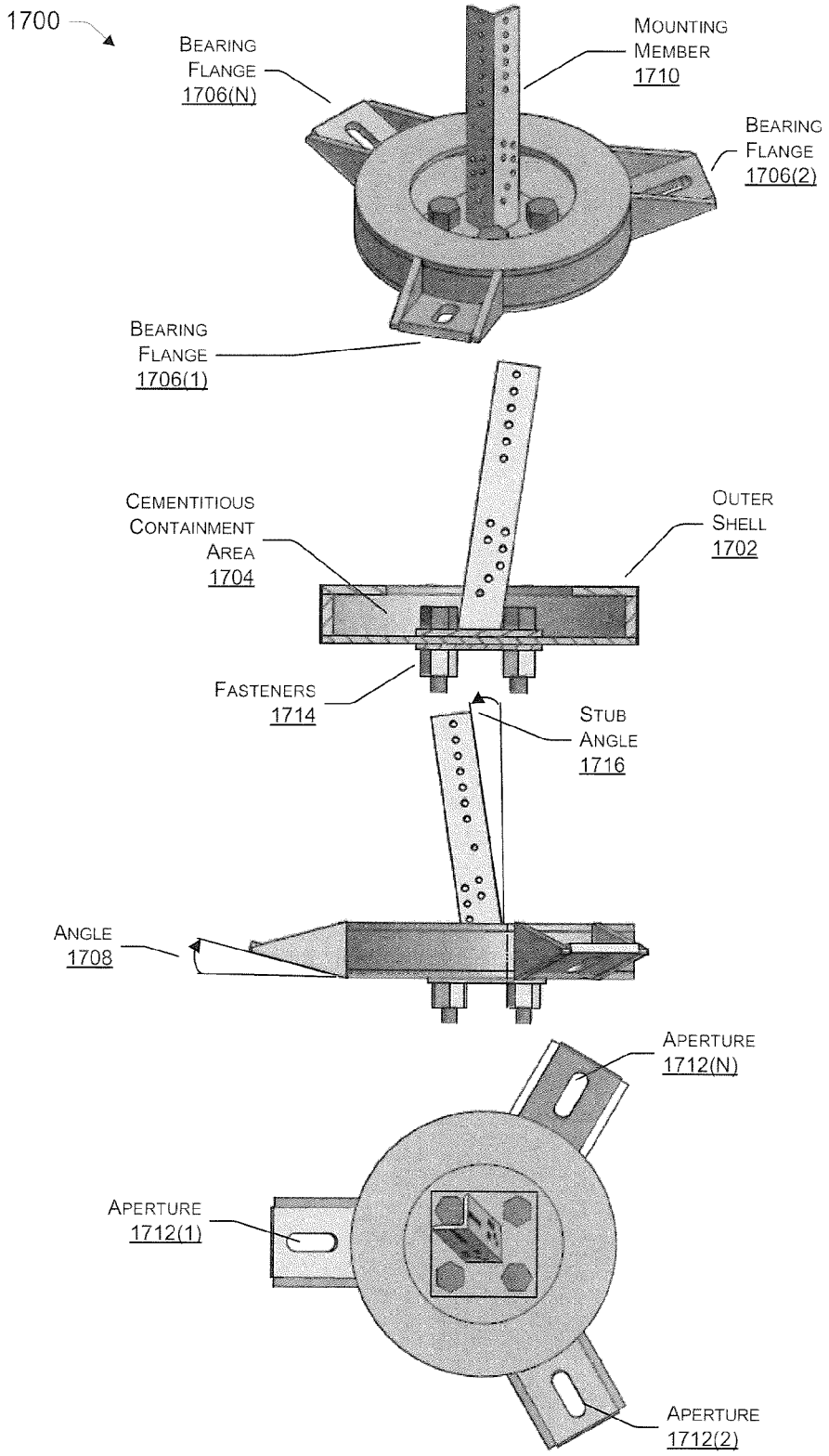
FIG. 17 illustrates an example structural cap that may be used to couple multiple piles with one another. As illustrated, the cap may include both a shell and a cementitious containment area that may be filled with a cementitious material. In addition, this cap may include a bearing flange having an angle designed to match a batter angle of the piles.

FIG. 17 illustrates an example structural cap 1700 that may be used to couple multiple piles or other structural members with one another and to a portion of a structure, such as a leg of a tower. As illustrated, structural cap 1700 may include both an outer shell 1702 and a cementitious containment area 1704 defined by outer shell 1702. In addition, this cap may include one or more bearing flanges 1706(1), 1706(2), . . . , 1706(N) each having an angle 1708 designed to match a batter angle of the piles to which the cap couples. Finally, structural cap 1700 may include a mounting member 1710 to attach to a portion of the structure that the pile foundation supports. For instance, mounting member 1710 may attach to a tower leg of a lattice tower.

As illustrated, outer shell 1702 may comprise a substantially circular base member and a substantially ring-shaped top member that is formed of metal (e.g., steel), plastic, or any other suitable material. In addition, the shell may comprise a containment wall attached perpendicularly on one side of the wall to a perimeter of the substantially circular base member and perpendicularly on an opposite side of the wall to the substantially ring-shaped top member.

As such, outer shell 1702 comprises a void within the shell that defines cementitious containment area 1704 configured to receive a cementitious mixture, such as cement or the like. In addition, bearing flanges 1706(1)-(N) may be arranged on along an outer perimeter of outer shell 1702. In some instances, structural cap 1700 may be designed to include an equal number of bearing flanges as a number of piles to which the cap is designed to couple with. For instance, a cap that is designed to secure a four-pile group of radial array battered micropiles may include four bearing flanges.

In these instances, each of bearing flanges 1706(1)-(N) may be further designed to include angle 1708 that matches a predetermined batter angle of the radial array of piles. As such, when a cap couples with the radial array of piles, each micropile may mate perpendicularly with a respective bearing flange. As such, the micropile may mate in a flush manner with the respective bearing flange, creating a secure interface between the pile and structural cap 1700.

In order to securely couple with each pile or other structural member, each of bearing flanges of structural cap 1700 may include a respective aperture 1712(1), 1712(2), . . . , 1712(N). In some instances, these apertures comprise an oval or circular aperture that receives a respective portion of a pile, such as a threaded bar of the like. After structural cap 1700 is placed on each pile of the radial array of piles, the cap may be secured in place via fasteners that couple to the threaded bar and reside on top of a respective bearing flange.

Furthermore, in some instances, apertures 1712(1)-(N) are designed to create a degree of tolerance between the respective bearing flange and the threaded bar of the battered micropile that the bearing flange receives. As such, an installer of structural cap 1700 may use this tolerance to ensure that each bearing flange of structural cap 1700 properly mates with a respective battered micropile.

As illustrated, mounting member 1710 attaches to a bottom center of outer shell 1702. More specifically, mounting member 1710 adjustably attaches via fasteners 1714 to the bottom member of the shell and protrudes out of the cementitious containment area 1704 to make a connection with the tower leg at a predetermined stub angle 1716 of the tower leg. Before connecting in this manner, however, mounting member 1710 may be adjusted into a position within the bottom center of cementitious containment area 1704 and securely fastened in place via fasteners 1714.

As the reader will appreciate, the adjustability of the mounting member 1710 allows the installer of cap 1700 to adjust mounting member 1710 to more precisely fit a location of the tower leg or other structural member to which cap 1700 couples. In addition, because mounting member 1710 attached to cap 1700 via fasteners 1714, this member is securely attached before the reception of the cementitious mixture, described immediately below.

After coupling structural cap 1700 to a group of piles or other structural members and after positioning mounting member 1710, an installer of the cap may proceed to fill cementitious containment area 1704 with a cementitious mixture, such as concrete or the like. After curing for a certain amount of time, the cementitious mixture functions to stiffen outer shell 1702 and support mounting member 1710.

As such, structural cap 1700 provides strength found in traditional concrete caps, while being of a lighter weight and requiring a lesser volume of materials than compared with traditional concrete caps. Hence, structural cap 1700 is more portable into a difficult-access work sites, such as work site 100. In addition, because structural cap 1700 requires far less cementitious mixture than traditional concrete caps, a cure time for installation of cap 1700 is much less, as is the required labor to install cap 1700. This smaller cure time and lesser labor enables the operator of work site 100 to more quickly and cost-effectively complete the series of foundations for the site. In addition to enabling quick and cost-effective installation, structural caps also enable for better quality control, as structural cap 1700 may be manufactured in a controlled environment (i.e., in a manufacturing facility) rather than in the field, as is common for concrete caps. In other words, the structural cap as described in FIG. 17 may be fabricated in a manufacturing facility that ensures quality control of the structural cap before providing the cap to the work site, such as difficult-access work site 100.

Figure 18:
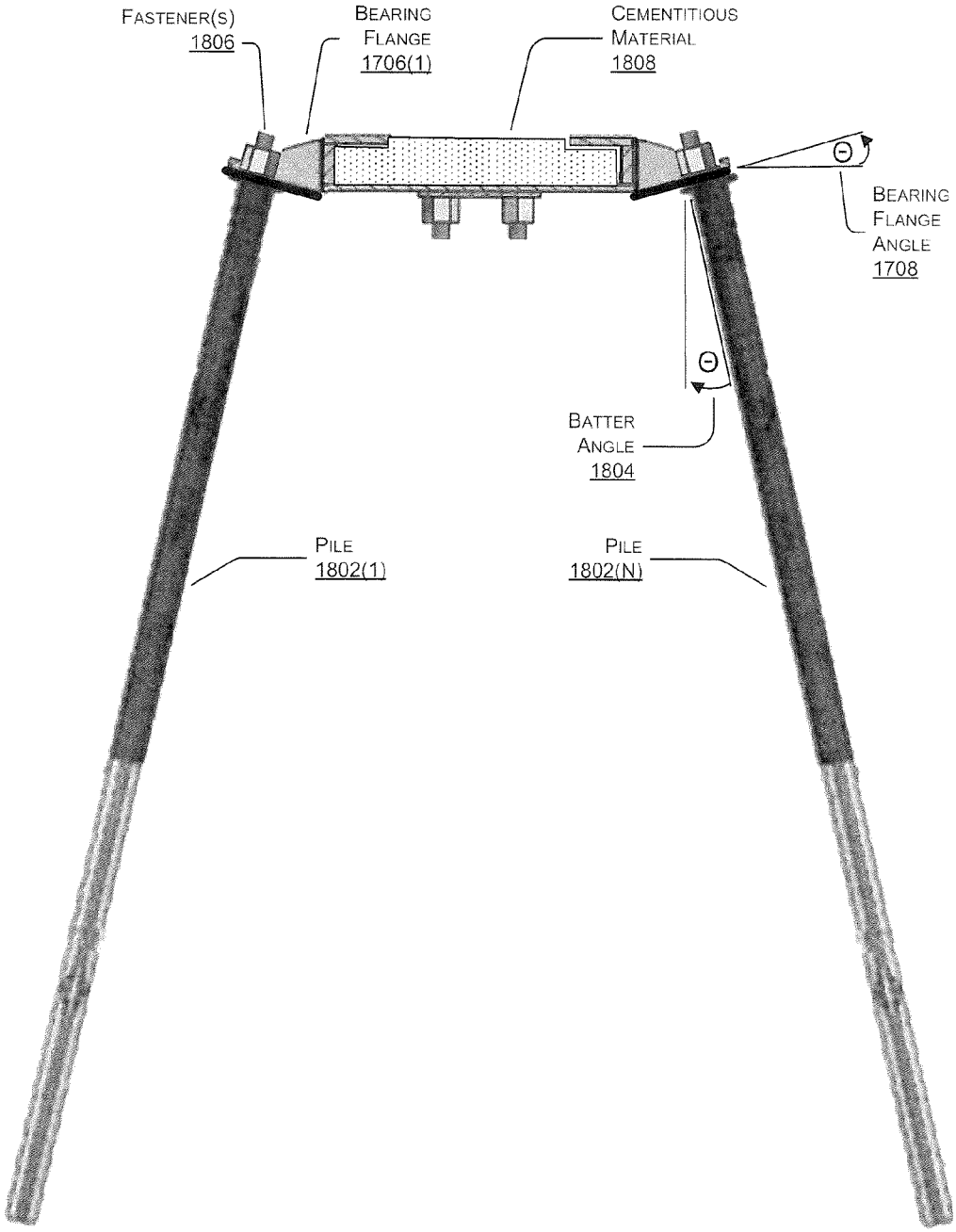
FIG. 18 illustrates a structural cap with angled bearing flanges coupling multiple piles with one another. As shown, the cementitious containment area of the cap has been filled with a cementitious material after securing the cap to the piles.

FIG. 18 illustrates structural cap 1700 with angled bearing flanges 1706(1)-(N) after the cap has been fastened to a radial array of micropiles 1802(1), . . . , 1802(N) each installed at a batter angle 1804. As shown, bearing flanges 1706(1)-(N) have been designed with an angle 1708 that matches batter angle 1804. In addition, each of bearing flanges 1706(1)-(N) has been coupled with a respective micropile 1802(1)-(N) via one or more fasteners 1806. As shown, due to the angle of the bearing flanges, each flange and respective micropile mate in a substantially perpendicular manner.

Finally, FIG. 18 illustrates that cementitious containment area 1704 of the cap has been filled with a cementitious material 1808 after securing the cap to the piles and after adjusting and fastening mounting member (not shown). After a sufficient cure time, an operator of work site 100 or another work site may couple a tower leg or other structural element to the completed foundation via the mounting member.

Figure 19:
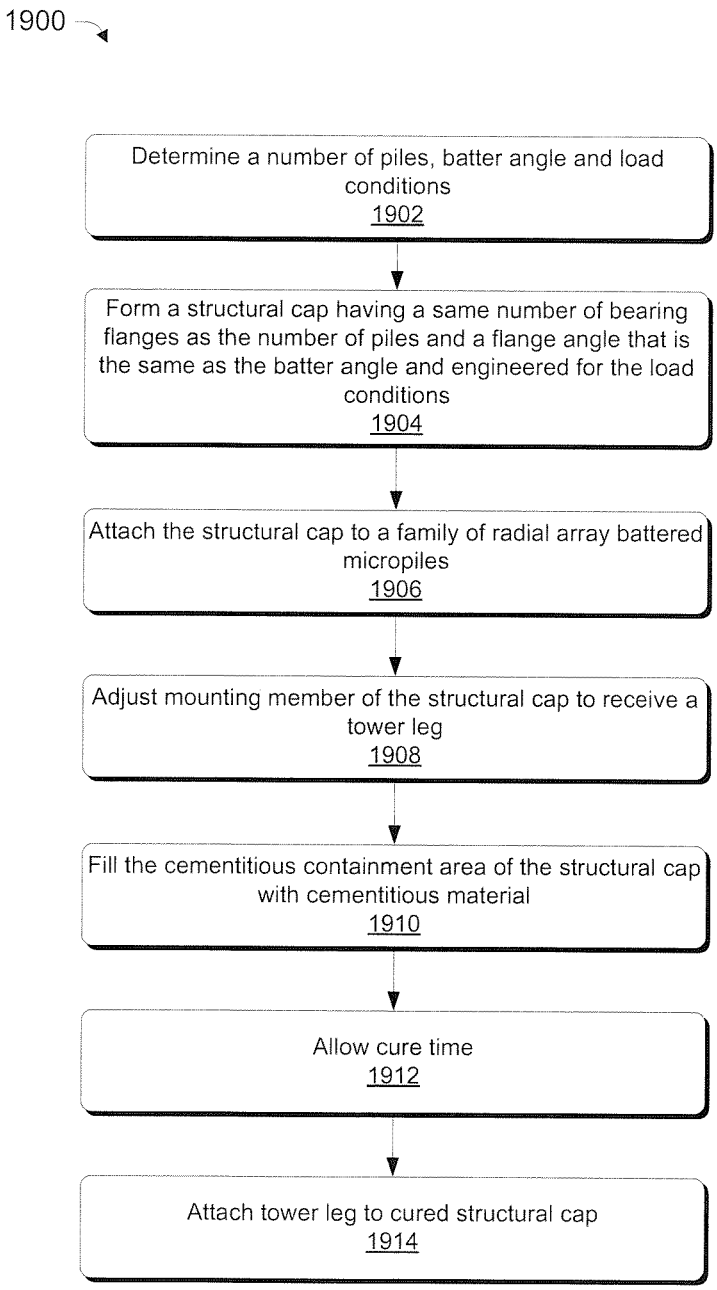
FIG. 19 is a flow diagram of an example process for designing, building and installing a structural cap to multiple piles. In some instances, this process designs bearing flanges of the cap to have an angle that matches a batter angle of the piles coupled together by the cap.

FIG. 19 is a flow diagram of an example process 1900 for designing, building and installing a structural cap to multiple piles or other structural elements, such as a group of a radial array of battered micropiles. In some instances, this process designs bearing flanges of the cap to have an angle that matches a batter angle of the piles coupled together by the cap, as illustrated and described above. In addition, because this cap may comprise both a metal outer shell and may be configured to receive a cementitious mixture, this structural cap may be known as a "composite cap."

Process 1900 includes determining, at operation 1902, characteristics of a group of piles or other members to which a structural cap will attach. For instance, operation 1902 may determine a number of piles, a batter angle of the piles, load conditions associated with the pile foundation and the like.

Next, operation 1904 represents forming a structural cap to comply with the determined characteristics. For instance, the cap may be designed to include a same number of bearing flanges as a number of piles in the foundation and a bearing flange angle that matches the determined batter angle. In addition, the dimensions of the cap may be engineered and designed to the meet the required load conditions.

At operation 1906, the formed structural cap is attached to the group of piles or other structural members, such as to a group of radial array battered micropiles, as described above. Operation 1908, meanwhile, represents adjusting a mounting member of the structural cap to receive a tower leg or other structural element. Next, operation 1910 represents filling the void of the cementitious mixture containment area with a cementitious mixture, such as concrete or the like. After allowing the mixture to cure at operation 1912, the operator may install the tower leg to the cured structural cap 1914.

Example Structural Cap with Sleeves and Associated Process

As described above with respect to FIG. 1, this document describes techniques to construct foundations, footings, anchors or the like for installing monopole towers, lattice towers or any other similar or different structure(s) in a difficult-access work site. As discussed with respect to FIG. 17, these techniques include using structural caps to couple multiple piles or other structural members with one another and to a portion of a structure, such as a leg of a tower. The structural caps described above may comprise bearing flanges that receive a respective portion of a pile, such as a threaded bar or the like. After the structural cap is placed on each pile of a radial array of piles, the cap may be secured in place via fasteners that couple to the threaded bar and that reside on top of a respective bearing flange.

Generally, securing structural caps to structural members (e.g., micropiles) via fasteners in this manner results in a pinned connection between the structural members and the resultant tower attached to the structural cap. Such a pinned connection provides the structural strength needed for some scenarios, such as when the structure attached to the structural cap comprises a monopole tower. In other design scenarios, however, a fixed connection between the structural members and the tower or tower leg provides better or more appropriate structural qualities.

For instance, pinned connections, such as the ones described above, effectively support towers that have a very high overturning moment relative to a low base shear, and a low compression load. Monopole towers often experience these kinds of loads and, hence, a pinned connection may work well when coupling a foundation to a monopole tower. However, pinned connections are less than ideal for towers that may experience a very high compression load relative to a high base shear and very small overturning moment. Instead, fixed connections effectively provide the strength needed for these connections. For example, these connections may work for latter towers, which include multiple legs, each coupled to respective foundation. Providing such fixity involves providing fixity to the connection of the leg of the tower to a structural cap and providing fixity between the structural cap and underlying structural members.

Figure 20:
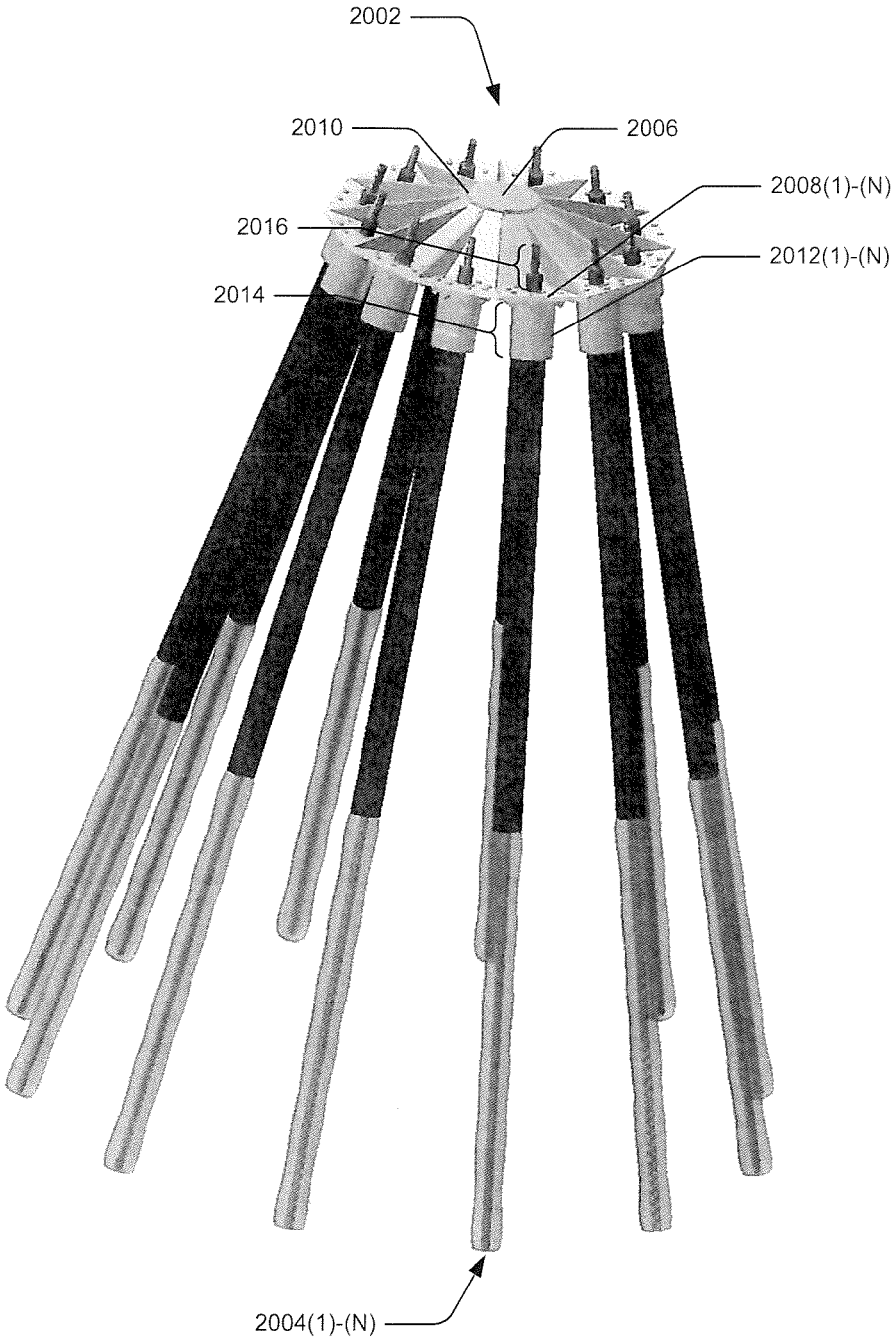
FIG. 20 illustrates an example structural cap with sleeves that may be used to fixedly couple multiple piles or other structural members with one another, as well as to a portion of a structure, such as a leg of a tower.

FIG. 20 illustrates an example structural cap 2002 that is fixedly coupled to multiple piles 2004(1), 2004(2), . . . , 2004(N). While FIG. 20 illustrates the structural cap coupled with battered micropiles, the structural cap 2002 may couple to non-battered micropiles, other types of piles, or any other type of structural members. In each instance, the cap also couples to a portion of a structure, such as a leg of a lattice tower.

As illustrated, structural cap 2002 may include both a body 2006 and one or more bearing flanges 2008(1), 2008(2), . . . , 2008(N) arranged along a perimeter 2010 of the body 2006. Further, structural cap 2002 includes one or more sleeves 2012(1), 2012(2), . . . , 2012(N) coupled to a respective bearing flange 2008(1)-(N). As discussed in detail below, these sleeves 2012(1)-(N) fixedly couple the structural cap 2002 to the multiple piles 2004(1)-(N).

More specifically, and as illustrated, sleeve 2012(1) receives a portion 2014 of a pile, while another portion 2016 of the pile passes through both the sleeve 2012(1) and the bearing flange 2008(1) and protrudes distal from the bearing flange 2008(1). Furthermore, subsequent to disposing the structural cap 2002 on the multiple piles 2004(1)-(N), each sleeve 2012(1)-(N) is filled with a cementitious material for fixedly coupling the structural cap 2002 to the multiple piles 2004(1)-(N).

While the structural cap 2002 may be formed of metal (e.g., steel) in some instances, any other suitable material may be used. In addition, structural cap 2002 may be designed to include an equal number of bearing flanges as a number of piles to which the structural cap is designed to couple with. For instance, a structural cap that is designed to secure a four-pile, radial array of micropiles may include four bearing flanges. These flanges may be integral with the body 2006 of the structural cap, or the flanges may detachably couple to the body to allow an operator to attach the bearing flanges to the body at a difficult-access work site.

Similar to the structural caps described above with respect to FIG. 17 and FIG. 18, each of the bearing flanges 2008(1)-(N) and sleeves 2012(1)-(N) may be further designed to include an angle 1708 that matches a predetermined batter angle 1804 of a radial array of piles. As such, when a structural cap couples with the radial array of piles, a portion of each micropile may be received by each sleeve 2012(1)-(N) with a respective angle 1708 matching predetermined batter angle 1804. The micropile may therefore be received in a flush manner with the respective sleeve 2012(1)-(N), providing a flush interface between the micropile and the structural cap. Of course, in some instance the piles, the flanges, and the sleeves may be designed without a batter angle (i.e., a batter angle of zero degrees).

With the design described above, the structural cap 2002 provides fixity between the micropiles 2004(1)-(N), the cap itself, and the subsequently attached tower leg. More specifically, the grout-filled sleeves that reside over the micropiles help result in a structure that effectively handles a very high compression load, a relatively high base shear, and a very small overturning moment.

Figure 21:
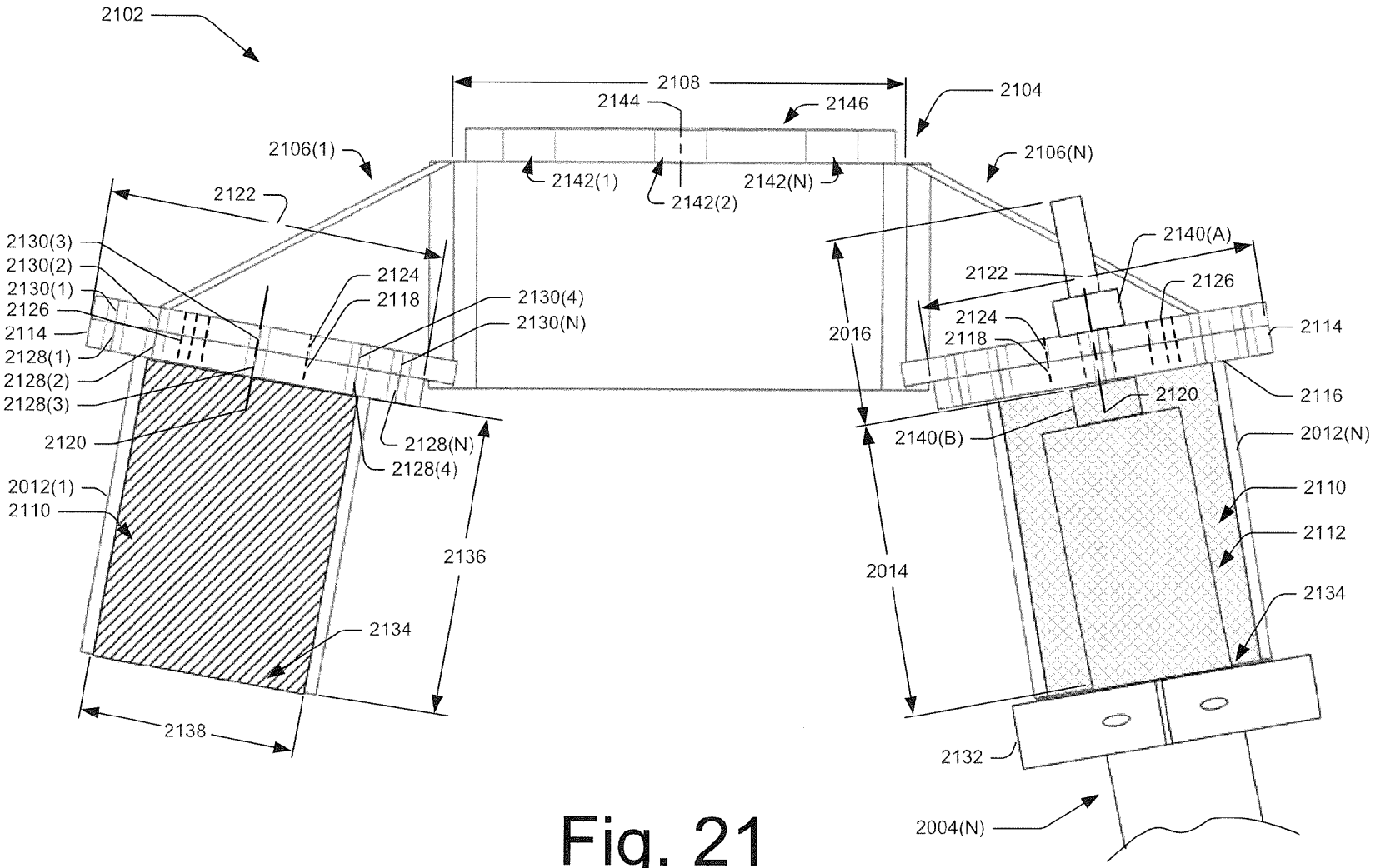
FIG. 21 illustrates a detailed side view of sleeves coupled to a structural cap, as well as fixedly coupled to multiple piles or other structural members.

FIG. 21 illustrates a side view of an example structural cap 2102 that may be used to fixedly couple multiple piles 2004(1)-(N) or other structural members with one another and to a portion of a structure, such as a leg of a tower. As illustrated, structural cap 2102 may include both a body 2104 and one or more bearing flanges 2106(1)-(N) arranged along a perimeter 2108 of the body 2104, as discussed above.

Again, structural cap 2102 includes one or more sleeves 2012(1)-(N) coupled to a respective bearing flange 2106(1)-(N). Further, each sleeve 2012(1)-(N) comprises a void 2110 to receive (1) a portion 2014 of a pile 2004(1)-(N), and (2) a cementitious mixture 2112 about the portion 2014 of a pile 2004(1)-(N). In other words, the purpose of the void 2110 is to receive the top of a pile along with a grout or other cementitious mixture in the remaining portion of the void that the pile does not fill. As such, the pile and the cementitious mixture fill all or substantially all of the void 2110.

FIG. 21 further illustrates that the sleeves may each include a plate 2114 fixed on an end 2116 of the each respective sleeve for fastening the sleeve to a corresponding bearing flange. As illustrated, plate 2114 includes an oversized aperture 2118 disposed substantially proximate to a center 2120 of a perimeter 2122 of plate 2114. FIG. 21 also illustrates that bearing flange 2106(N) also includes an aperture 2124 concentric to center 2120. The oversized aperture 2118 of sleeve 2012(N) and the aperture 2124 of bearing flange 2106(N) are configured to receive the other portion 2016 of a pile 2004(1)-(N) distal to the portion received by the void 2110. As illustrated, the another portion 2016 of pile 2004(1)-(N) passes through both the plate 2114 and the bearing flange 2106(N) and protrudes distal from the bearing flange 2106(N). Each of the "oversized" apertures described herein may be oversized relative to the fasteners used within these apertures, thus providing the operator or installer of the structural cap additional tolerance to couple to the cap to a group of structural members.

FIG. 21 further illustrates the cross-section of a port 2126, which is disposed in plate 2114 and the bearing flange 2106(1)-(N) and is arranged around the oversized aperture 2118. In some instances, the structural cap includes multiple ports, which allow an operator to fill the sleeve with a cementitious mixture after the sleeve has been placed over the pile. The ports may also act as overflow vents for allowing the cementitious mixture to exit the sleeve after the operator entirely fills any remaining portion of the void that the pile does not occupy. These ports may also act as vents that allow the cementitious mixture to cure after the sleeves are filled.

While the port 2126 serves as a vent for the void 2110 when receiving the cementitious mixture 2112 as discussed above, other venting mechanisms are contemplated. For example, oversized aperture 2118 and aperture 2124 may vent the void 2110. FIG. 21 also illustrates multiple through-holes 2128(1)-(N) arranged around the perimeter 2122 of plate 2114, as well as multiple through-holes 2130(1)-2130(N) equally arranged around the aperture 2124 of the bearing flange 2106(1) for receiving threaded fasteners or other types of fasteners. For example, plate 2114 may be fixed to the bearing flange 2106(1) via a weld (not shown) arranged about the perimeter 2122 of the plate 2114 to flange 2106(1).

In some implementation, a sleeve may be placed over a pile such that the bottom of the sleeve contacts and rests against the ground in which the pile protrudes from. Here, the ground functions to effectively "close" the open end of void 2110, thus allowing the operator to fill the void 2110 with a cementitious mixture through the port 2126 or oversized aperture. That is, the operator may insert a grout or other material through the port or aperture, with the ground ensuring that the void of the sleeve that is not filled by the pile will be filled by the cementitious mixture.

In other instances, meanwhile, a pile may protrude from the ground to such a degree that the sleeve will not contact the ground when placed over the pile. That is, the length of the pile that protrudes from the ground may be longer than the length of the sleeve, as illustrated by the pile 2004(N) of FIG. 21. In these instances and as illustrated, the sleeve 2012(N) may further comprise a packing ring 2132 disposed adjacent to an open end 2134 of the sleeve 2012 (N) distal to the plate 2114. Similar to the ground discussed above, the packing ring 2132 encloses the void 2110. As such, an operator that is on site may attach the packing ring 2132 after placing the sleeve 2012(N) over the pile 2004(N). The operator may then proceed to fill the remaining portion of the void 2110 with a cementitious mixture, such as grout.

In instances where a structural cap is being coupled to multiple piles 2004(1)-(N) that are installed on a slope, the sleeves that reside on the uphill side of the slope may contact the ground, while the sleeves on the downhill side may not. As such, the sleeves that reside on the downhill side of the slope may include the packing ring 2132 for enclosing void 2110, while the uphill sleeves may not.

Furthermore, in some instances, the illustrated sleeves may be designed to have a larger void, thus creating a degree of tolerance between the respective sleeve 2012 and the portion 2014 of the pile the sleeve receives. As such, an installer of structural cap 2102 may use this tolerance to ensure that each sleeve 2012(1)-(N) of the structural cap 2102 properly mates with a respective battered micropile or other structural member. Likewise, in some instances, oversized aperture 2118 and aperture 2124 are designed to create a degree of tolerance between the plate 2114, bearing flange 2106(1)-(N), and the other portion 2016 of respective pile 2004(1)-(N) that the sleeve 2012(1)-(N) receives.

FIG. 21 further illustrates that the sleeves 2012(1)-(N) may have a height 2136 of approximately about 16 inches (406 millimeters) and an inner diameter 2138 of approximately about 12 inches (304 millimeters) in one particular example. While FIG. 21 illustrates a single example, the height 2136 and diameter 2138 of the sleeve are configurable to provide a void 2110 to receive a sufficient amount of cementitious mixture 2112 based on pile 2004(1)-(N) size and a predetermined expected load for piles 2004(1)-(N).

Finally, and as illustrated, each respective pile 2004(1)-(N) may couple to a respective sleeve and bearing flange via one or more fasteners 2140(A) and 2140(B). As discussed below, an operator may place the fastener 2140(B) at a particular vertical location on the top of the respective pile so as to level the top of the sleeve with other sleeves of the structural cap.

After an operator attaches structural cap 2102 to the pile group and after the cementitious mixture within the void 2110 cures, the operator may attach a tower leg or other structure to the cap and, hence, to the foundation. As discussed above with reference to FIG. 17, the tower leg may attach to a mounting member that is designed to have an angle that matches the angle of the tower leg.

While FIG. 21 does not illustrate the mounting member, the body 2104 of the cap includes several features to enable for effectively attaching the tower leg to a mounting member of the cap. For instance, FIG. 21 illustrates multiple through-holes 2142(1), 2142(2), . . . , 2142(N) that extend through the body 2104 and are arranged around a center 2144 of the body 2104. FIG. 21 illustrates that the body 2104 has a substantially planar surface 2146 configured to attach flush with a mounting member via threaded fasteners disposed in respective through-holes 2142(1)-(N). When attached, the mounting member protrudes from the body substantially at the center 2144 of the body 2104 and is configured to receive the leg of the tower, as described above, with respect to FIG. 17.

In some instances the mounting member may comprise both a stub angle protruding upwards from the cap and a plate disposed flush against the planar surface 2146 of the body 2104. When the body and the plate are circular in shape, the plate may be concentric with the center 2144 of the body 2104. In addition, the plate of the mounting member may further comprise through-holes arranged around a perimeter of the plate for receiving the threaded fasteners to couple the mounting member to the body of the cap. Again, the mounting member may also comprise a stub angle protruding from the plate. The stub angle may have been previously welded proximate to the center of the plate of the mounting member.

Furthermore, when attaching the mounting member to the body of the cap, an operator may interpose a fastening ring (or washer) between the plate of the mounting member and the body of the cap. In addition, the operator may include another fastening ring underneath the body of the cap prior to placing fasteners through the plate of the mounting member, the first fastening ring, the body of the cap and second fastening ring. To enable the operator to attach the mounting member, the fastening rings, and the body of the cap in this manner, each fastening ring may also have multiple through-holes for receiving the threaded fasteners. Prior to attaching the mounting member to the body of the cap, the operator may align the through-holes of the fastening rings, the plate of the mounting member, and the body of cap In some instances, the through-holes of the fastening rings, the plate, and the body of the cap are oversized to allow the operator some tolerance when attaching the mounting member. That is, in instances where a group of piles has been installed at a location that is slightly different than the designed location, the operator may offset this difference by slightly adjusting where the mounting member attaches to the body of the cap. The oversized holes discussed immediately above enable such an offset.

With the design above, structural cap 2102 provides strength and fixity provided by traditional concrete caps while providing significant advantages over a concrete cap. For instance, structural cap 2102 is much lighter than a traditional concrete cap and requires a lesser volume of materials than compared with traditional concrete caps. Hence, structural cap 2102 is more portable into a difficult-access work sites, such as work site 100. In addition, because structural cap 2102 requires far less cementitious mixture than traditional concrete caps, a cure time for installation of cap 2102 is much less. Furthermore, the labor required to a concrete cap far exceeds the labor required to install structural cap 2102. This smaller cure time and quicker installation enables the operator of work site 100 to more quickly and cost-effectively complete the series of foundations for the site. Structural cap 2102 also enables for better quality control, as structural cap 2102 may be manufactured in a controlled environment (i.e., in a manufacturing facility) rather than in the field, as is common for concrete caps.

Alternative Illustrative Structural Caps

In the implementations shown in FIGS. 20 and 21, the structural cap is shown as having a generally circular body having a planar surface formed therein. However, in other implementations, the structural cap may take any other desired forms, such as generally rectangular shape, a generally triangular shape, an oval shape, or the like. Further, and as discussed above, the number of bearing flanges on a particular structural cap may equal the number of piles to which the structural cap is designed to couple with.

Figure 22A:
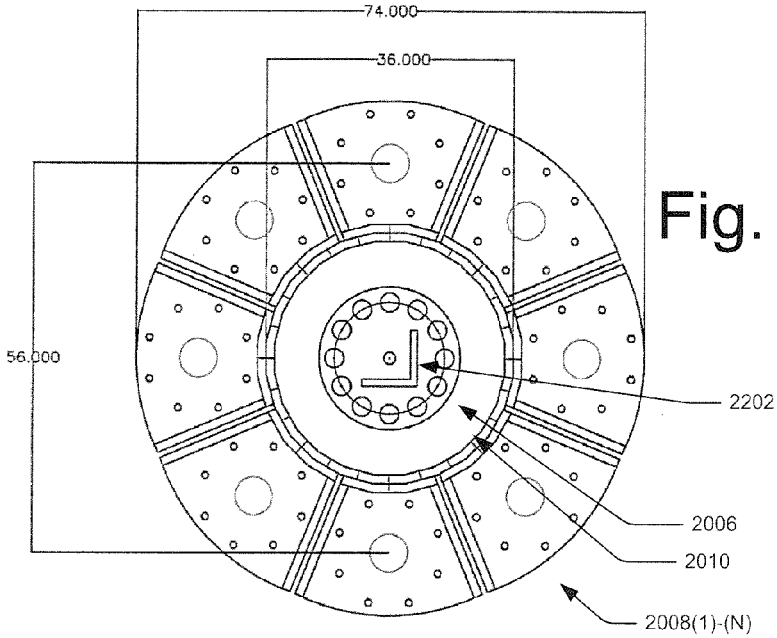
FIGS. 22A-22D show several alternatively shaped structural caps.
Figure 22B:
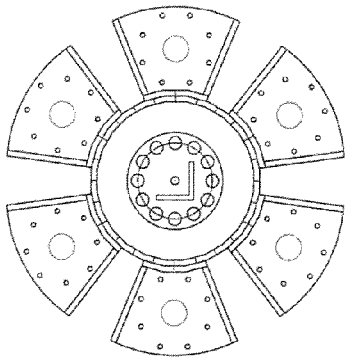
Figure 22C:
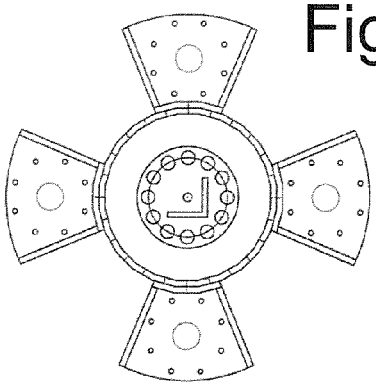
Figure 22D:
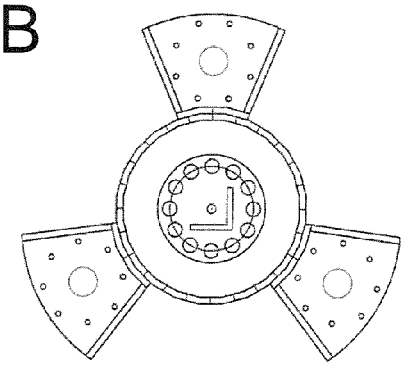

For example, FIG. 22A through FIG. 22D show several alternative structural caps, each having a different number of bearing flanges arranged along a perimeter of the body and configured to couple with respective sleeves. These example structural caps also illustrate example sizes. For instance, FIG. 22A illustrates a structural cap having an outer diameter of 74 inches (188 centimeters), an outer perimeter diameter of 36 inches (91 centimeters), and a flange-to-flange distance of 56 inches (142 centimeters). Of course, while a single example has been provided, other structural caps may be designed to have any other set of similar or different dimensions.

Example Processes of Installing a Structural Cap with Sleeves

Figure 23:
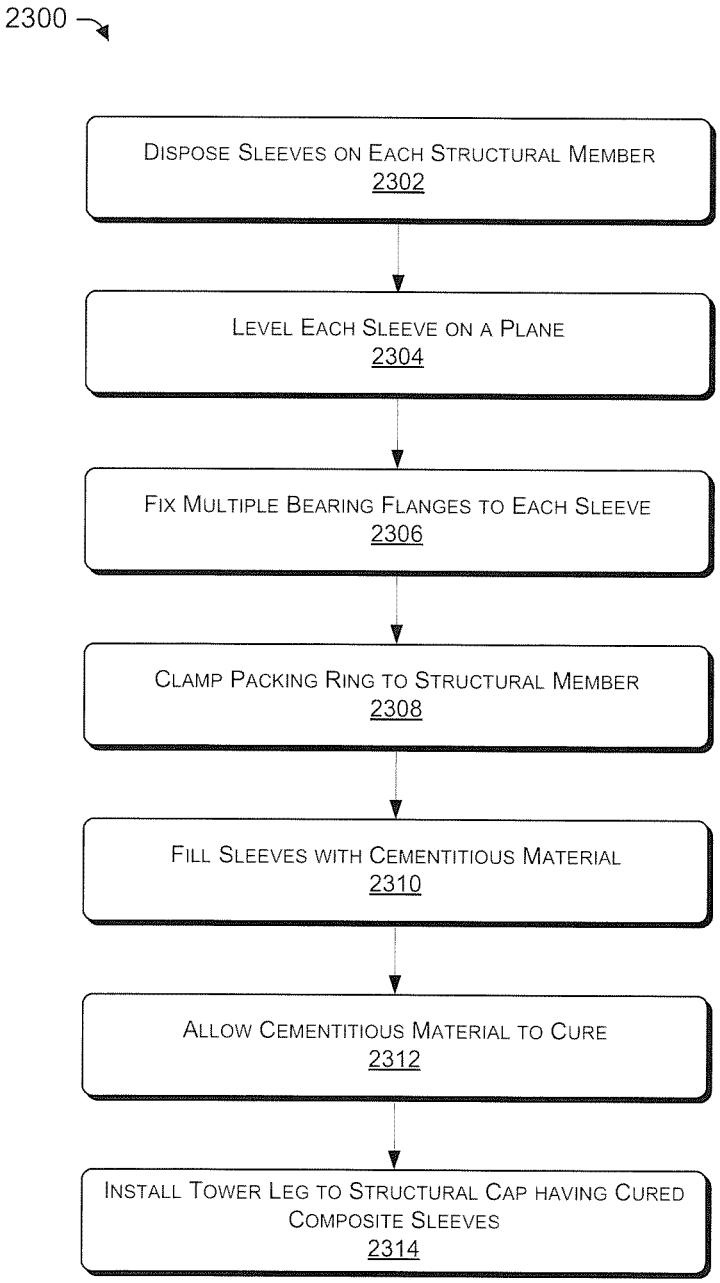
FIG. 23 illustrates an example process for installing a structural cap and sleeves to multiple structural members.

FIG. 23 illustrates an example process 2300 for installing a structural cap to a group of structural members, such as a radial array of battered micropiles or any other group of structural members. Process 2300 includes disposing, at operation 2302, a sleeve on a portion of each of the structural members. For instance, operation 2302 may dispose a sleeve on a portion of a pile such that the portion of the pile is disposed in a void of the sleeve. After disposing the sleeves onto the structural members, an operator of a site may level each of the sleeves using a leveling jig or through another iterative process at operation 2304. In some instances, one or more of the sleeves are integral with a body of a structural cap, while in other instances the sleeves couple to the body of the cap after being placed on the structural members, as discussed below.

Next, operation 2306 fixes multiple bearing flanges arranged along a perimeter of a body of the structural cap to each of the sleeves disposed on the portions of the structural members. To do so, each of the sleeves may be fastened to a respective bearing flange via threaded fasteners, via a weld, or in any other suitable manner.

At operation 2308, an operator clamps at least one packing ring to one of the structural members. As discussed above, the packing ring is disposed adjacent to an open end of the sleeve and encloses the sleeve to contain the cementitious material within the sleeve.

Next, operation 2310 represents filling each of the sleeves with a cementitious material, such as, grout, concrete, cement or the like, for fixedly coupling each of the sleeves to the portion of the respective structural member disposed in the sleeve. For instance, an operator of work site 100 may choose to back-fill the void of the sleeve via apertures and vent the void via a port while back-filling. After allowing the cementitious material to cure at operation 2312, the operator may install the tower leg to the structural cap having cured sleeves at operation 2314.

Figure 24:
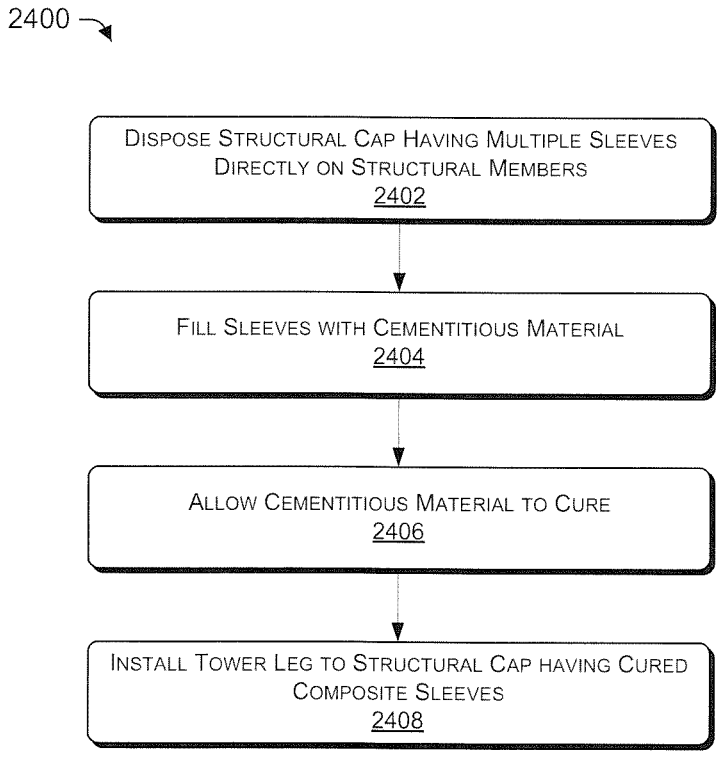
FIG. 24 illustrates an alternative example process for installing a structural cap and sleeves to multiple structural members.

FIG. 24 illustrates an alternative example process 2400 for installing a structural cap to a group of structural members. In this instance, this process may install the structural cap onto substantially vertical structural members, such as onto a non-battered radial array of piles. Because of the vertical nature of the piles, the structural cap may comprise a body, bearing flanges, and sleeves, each fixedly attached (e.g., welded) to one another at a manufacturing facility prior to the installation process.

Process 2400 includes disposing, at operation 2402, a structural cap on the group of structural members. For instance, operation 2402 may dispose a structural cap comprising multiple sleeves respectively coupled to the multiple bearing flanges arranged along a perimeter of a body. Here, the bearing flanges are arranged substantially vertically along the perimeter of the body, with respective sleeves coupled to the bearing flanges. In this configuration, the structural cap may be directly disposed on the group of structural members along with the sleeves. Again, the sleeves are configured to receive a portion of each pile, such that the portion of the pile is disposed in a void of the sleeve.

Process 2400 also includes filling, at operation 2404, each of the sleeves with a cementitious material, such as concrete or the like, for fixedly coupling each of the sleeves to the portion of the respective structural member disposed in the sleeve. For instance, an operator of work site 100 may choose to back-fill the void of the sleeve via apertures and vent the void via a port while back-filling. After allowing the cementitious material to cure at operation 2406, the operator may install the tower leg to the cured structural cap at operation 2408.

Example Structural Cap with a Core and Sleeves and Associated Process

Figure 25:
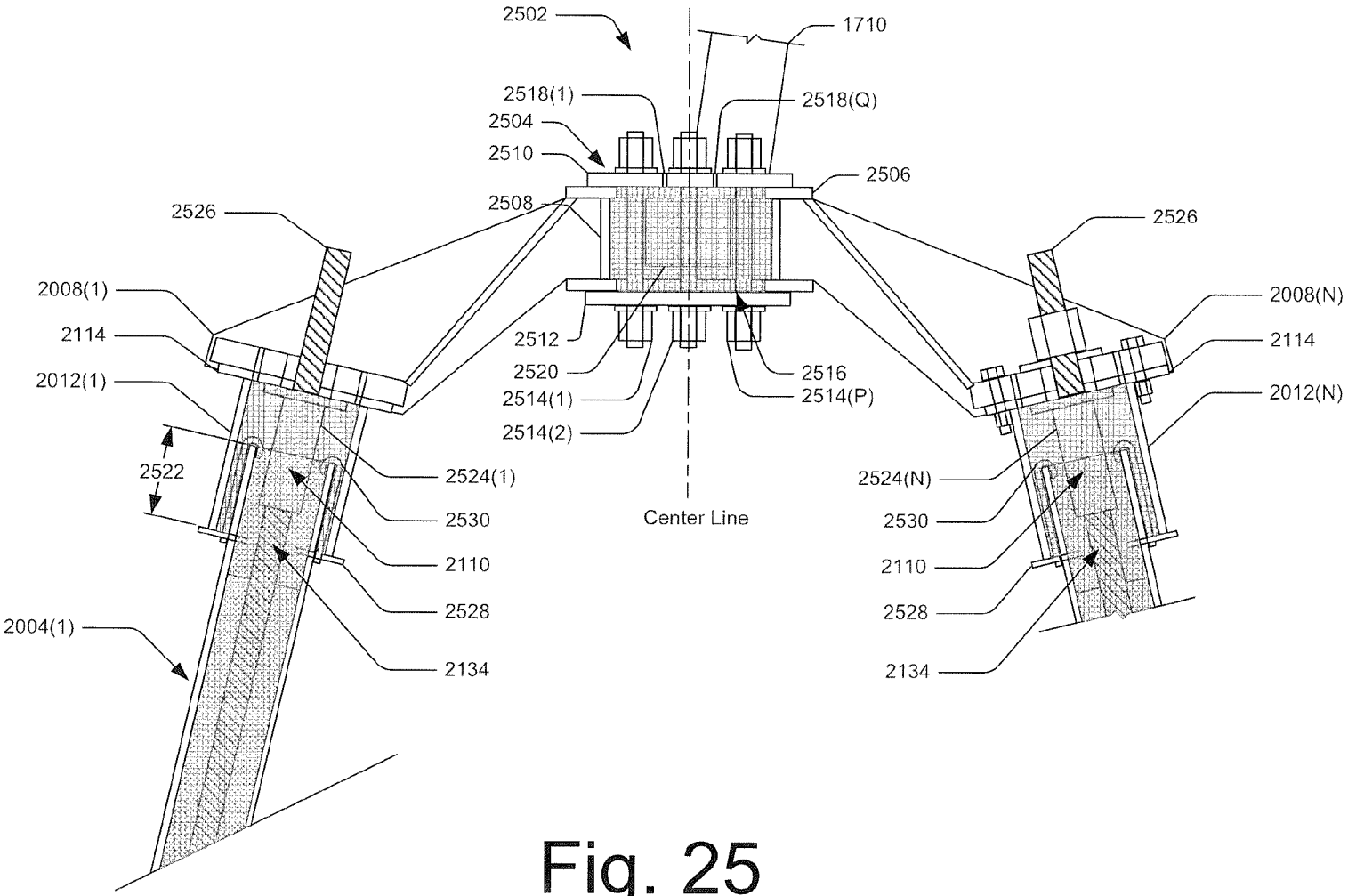
FIG. 25 is a cross-section of an illustrative structural cap that may be used to couple multiple structural members with one another. As illustrated, the cap may include both a core having a cementitious containment area and sleeves having a cementitious containment area. In some instances, the cementitious containment areas may be filled with a cementitious material after securing the cap to the structural members.

FIG. 25 is a cross-section of an illustrative structural cap 2502 that is fixedly coupled to multiple piles 2004(1)-2004(N). While FIG. 25 illustrates the structural cap 2502 coupled with battered micropiles, the structural cap 2502 may couple to non-battered micropiles, other types of piles, or any other type of structural members. In each instance, the cap may also couple to a portion of a structure, such as a leg of a lattice tower.

As illustrated, structural cap 2502 may include a core 2504 having one or more bearing flanges 2008(1)-2008(N) arranged along a perimeter 2506 of the core 2504. The bearing flanges 2008(1)-2008(N) may be coupled to a respective sleeve 2012(1)-2012(N). As discussed in detail below, these sleeves 2012(1)-2012(N) are to fixedly couple the structural cap 2502 to the multiple piles 2004(1)-(N) or other structural members.

The core 2504 of structural cap 2502 may include a tube 2508 in between a top plate 2510 and a bottom plate 2512. One or more threaded fasteners 2514(1), 2514(2), . . . , 2514(P) may be tightened to secure the top plate 2510 and the bottom plate 2512 to the tube 2508. In some instances, the tube 2508, the top plate 2510, and the bottom plate 2512 may be separate from one another when dissembled, in other instances some or each of these components may be integral with one another. In each instance, when the top plate 2510 and the bottom plate 2512 are secured to the tube 2508, the core 2504 defines a void 2516. The void 2516 may receive a cementitious mixture via one or more ports 2518(1)-2518(Q) arranged around a center of the top plate 2510. In addition to providing an opening to receive the cementitious mixture into the void 2516, the one or more ports 2518(1)-2518(Q) may also vent the void 2516 of the core 2504 while receiving the mixture. As discussed in detail below, the core 2504 may fixedly couple the structural cap 2502 to a tower leg.

In this regard, FIG. 25 illustrates that the void 2516 of the core 2504 receives a post member 2520 attached to the top plate 2510 of the core opposite to a mounting member 1710 also attached to the top plate 2510 of the core 2504. The mounting member 1710 protrudes distal from the core 2504 to receive the leg of the tower. The post member 2520 protruding into the void 2516 of the core 2504 may resist a shear load experienced by the structural cap 2502.

FIG. 25 illustrates that the sleeve 2012(1) receives a portion 2522 of pile 2004(1). One or more leveling couplers 2524(1), 2524(2), . . . , 2524(N) may be received by the void 2110 of a respective sleeve 2012(1)-2012(N). The leveling couplers 2524(1)-2524(N) may be coupled distal to the respective portion 2522 of each pile 2004(1)-(N) for leveling the structural cap 2502. The leveling couplers 2524(1)-2524(N) may comprise a washer fixed (e.g., welded) to an end of a female threaded tube. Each of the leveling couplers 2524(1)-2524(N) may be coupled to the respective portion 2522 of each pile 2004(1)-(N). For example, each of the leveling couplers 2524(1)-2524(N) may be threaded to a respective threaded bar portion of each pile 2004(1)-(N). Each sleeve 2012(1)-2012(N) may be disposed on a respective leveling coupler 2524(1)-2524(N) such that the void 2110 of each sleeve 2012(1)-2012(N) receives a respective leveling coupler 2524(1)-2524(N) coupled distal to the respective portion 2522 of each pile 2004(1)-(N). The sleeves 2012(1)-2012(N) may comprise a substantially circular tube, a substantially oval tube, a substantially polygonal tube, or the like.

Each of the leveling couplers 2524(1)-2524(N) are configured to be in contact with each respective plate 2114 of each sleeve 2012(1)-2012(N). A fastening member 2526 (e.g., a post, a bar, a threaded bar, a notched bar, or the like) may be coupled distal to each leveling coupler 2524(1)-2524(N). The fastening member 2526 passes through both the sleeve 2012(1) and the bearing flange 2008(1) and protrudes distal from the bearing flange 2008(1). In these instances and as illustrated, each of the sleeves 2012(1)-(N) may further comprise a containment washer 2528 disposed adjacent to the open end 2134 of each of the sleeves 2012(1)-(N) distal to each of the plates 2114, respectively.

The containment washer 2528 encloses the void 2110. As such, an operator that is on site may slip the containment washer 2528 onto each pile 2004(1)-(N) prior to disposing each sleeve 2012(1)-2012(N) on each leveling coupler 2524 (1)-2524(N). As illustrated, the containment washer 2528 may include an electrically-conductive fastener 2530. The conductive fastener 2530 may fasten a containment washer 2528 adjacent to the open end 2134 of each of the sleeves 2012(1)-(N) distal to each of the plates 2114, respectively. The conductive fastener 2530 may electrically ground the structural cap 2502 to a pile 2004(1)-(N). For example, the electrically-conductive fastener 2530 may be a J-bolt hooked on an end of the portion 2522 of a pile 2004(1)-(N) received by a sleeve 2012(1)-(N), respectively, and the threaded end of the J-bolt may be fastened to the containment washer 2528 disposed adjacent to the open end 2134 of the sleeves 2012 (1)-(N). The operator may then proceed to fill the remaining portion of the void 2110 with a cementitious mixture, such as grout, for fixedly coupling the structural cap 2502 to the multiple piles 2004(1)-(N).

While the structural cap 2502 may be formed of metal (e.g., steel, galvanized steel, or the like) in some instances, any other suitable material may be used. In addition, structural cap 2502 may be designed to include an equal number of bearing flanges 2008(1)-(N) as a number of piles to which the structural cap 2502 is designed to couple with. For instance, a structural cap 2502 that is designed to secure a four-pile, radial array of micropiles may include four bearing flanges 2008(1)-(N). These flanges 2008(1)-(N) may be integral with the core 2504 of the structural cap 2502, or the flanges 2008 (1)-(N) may detachably couple to the core 2504 to allow an operator to attach the bearing flanges to the body at a difficult-access work site.

Similar to the structural caps described above with respect to FIG. 17 and FIG. 18, each of the bearing flanges 2008(1)-(N) and sleeves 2012(1)-(N) may be further designed to include an angle 1708 that matches a predetermined batter angle 1804 of a radial array of piles. As such, when a structural cap couples with the radial array of piles, a portion (e.g., portion 2522) of each micropile may be received by each sleeve 2012(1)-(N) with a respective angle 1708 matching predetermined batter angle 1804. The micropile may therefore be received in a flush manner with the respective sleeve 2012(1)-(N), providing a flush interface between the micropile and the structural cap. Of course, in some instance the piles, the flanges, and the sleeves may be designed without a batter angle (i.e., a batter angle of zero degrees).

Also similar to the structural caps described above with respect to FIG. 17 and FIG. 18, the mounting member 1710 may be adjusted into a position to more precisely fit a location of the tower leg or other structural member to which structural cap 2502 couples. Here, as discussed above, the mounting member 1710 may be fixed to the top plate 2510 and the top plate 2510 may rest flush against the tube 2508 of the core 2504. Because the top plate 2510 may rest flush against the tube 2508 and may adjustably attach via fasteners 2514(1)-2514(P) to the bottom plate 2512 of the core 2504, the top plate 2510 is adjustable. For example, the top plate 2510 may move translationally and/or rotationally relative to the tube 2508 of core 2504. More specifically, with the mounting member 1710 fixed to the top plate 2510, a position of the mounting member 1710 relative to the core 2504 of the structural cap 2502 is adjustable. The mounting member 1710 may protrude distal from the core 2504 to make a connection with the tower leg at a predetermined stub angle 1716 of the tower leg. Before connecting in this manner, however, mounting member 1710 may be adjusted into a position on top of the tube 2508 of the core 2504 and securely fastened in place via fasteners 2514(1)-2514(P).

As the reader will appreciate, the adjustability of the mounting member 1710 allows the installer of structural cap 2502 to adjust the mounting member 1710 to more precisely fit a location of the tower leg or other structural member to which structural cap 2502 couples. In addition, because the mounting member 1710 may be attached to the structural cap 2502 via fasteners 2514(1)-2514(P), the mounting member 1710 is securely attached before the reception of the cementitious mixture, described below.

With the design described above, the structural cap 2502 provides fixity between the micropiles 2004(1)-(N), the structural cap 2502 itself, and the subsequently attached tower leg. More specifically, the grout-filled core 2504 fixed to the stub angle and the grout-filled sleeves 2012(1)-2012(N) that reside over the micropiles help result in a structure that effectively handles a very high compression load, a relatively high base shear, and a very small overturning moment.

Figure 26:
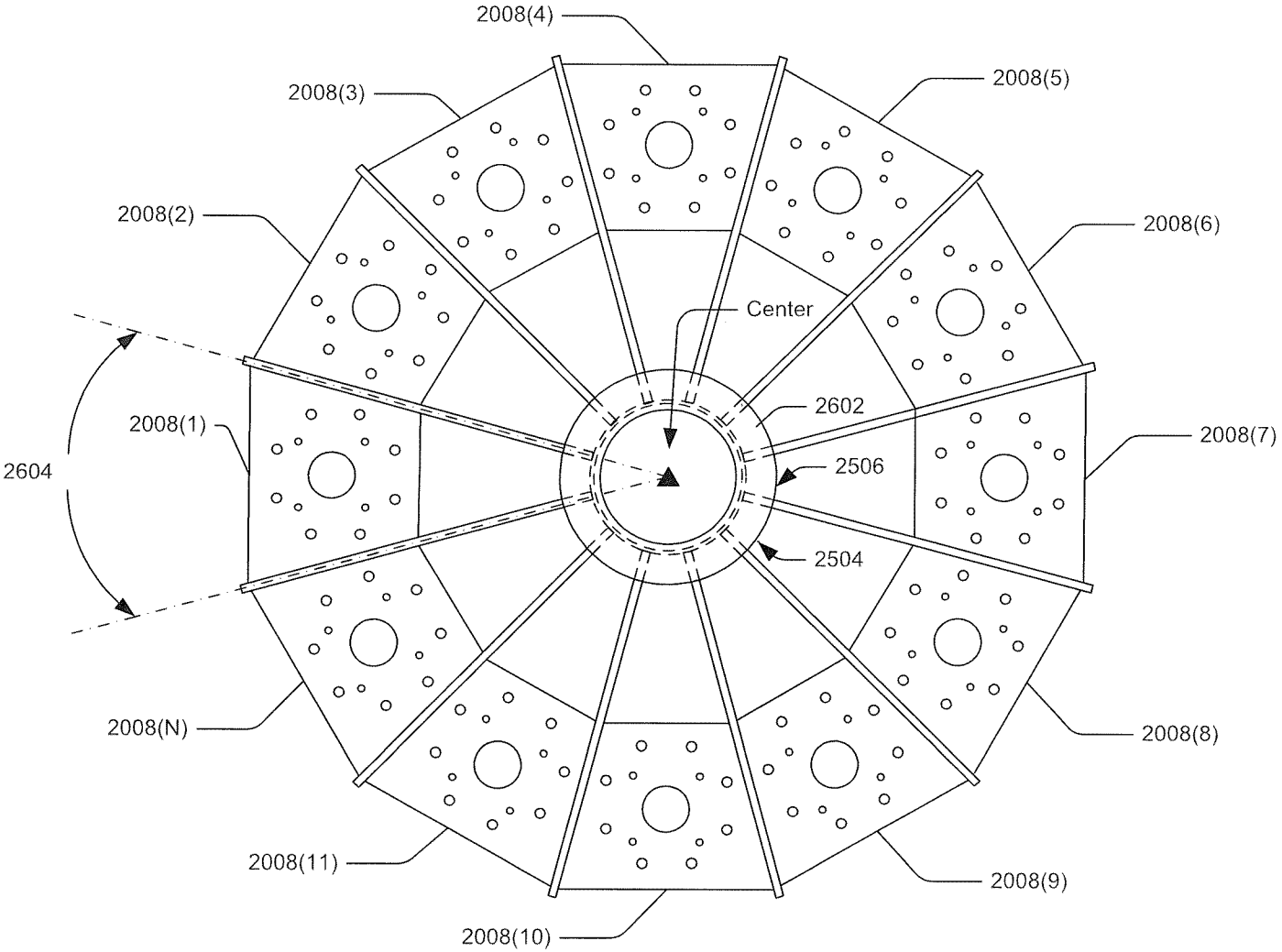
FIG. 26 is a top view and illustrates the bearing flanges fixed on the perimeter of the core of the structural cap of FIG. 25.

FIG. 26 illustrates a top view of twelve bearing flanges 2008(1)-2008(12) arranged along a perimeter 2506 of the core 2504 of the structural cap 2502. The core 2504 of the structural cap 2502 is shown as having a generally circular body having a planar surface 2602 formed thereon. However, in other implementations, the core 2504 may take any other desired forms, such as generally rectangular shape, a generally triangular shape, an oval shape, or the like.

Further, and as discussed above, the number of bearing flanges on a particular structural cap may equal the number of piles or other structural members to which the structural cap is designed to couple with. As discussed above with respect to FIG. 22A, the structural cap 2502 may be designed to have any set of dimensions. For instance, each bearing flange 2008 (1)-2008(12) arranged along the perimeter 2506 of the core 2504 of the structural cap 2502 may have a total width 2604 of 30 inches (76 centimeters). While a single example has been provided, other structural caps may be designed to have any other set of similar or different dimensions.

Figure 27A:
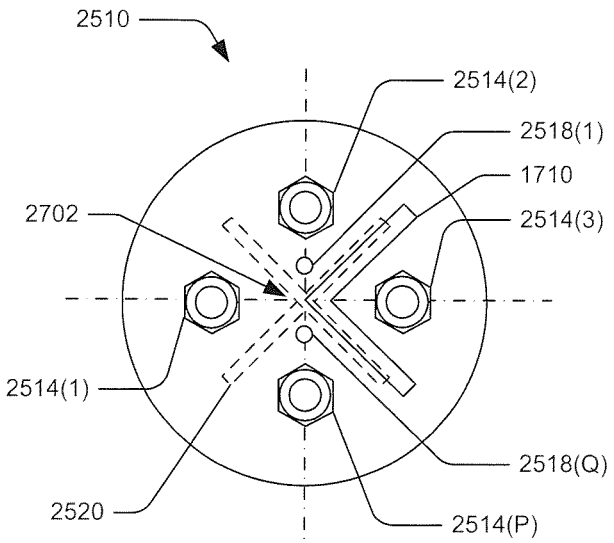
FIGS. 27A, 27B, and 27C are top, bottom, and side views, respectively, of an illustrative top plate of the structural cap of FIG. 25. As illustrated, the top plate of the core may include a mounting member attached to the top plate opposite to a post member fixed to the top plate.

FIG. 27A illustrates a top view of the top plate 2510 of the structural cap 2502 illustrated in FIG. 25. The top plate 2510 of the structural cap 2502 is shown as having a circular body having a planar surface. However, in other implementations, the top plate 2510 may take any other desired forms, such as generally rectangular shape, a generally triangular shape, an oval shape, or the like suitable for resting flush on the core 2504.

As illustrated, the mounting member 1710 may be fixed substantially proximate to a center 2702 of the top plate 2510 opposite to the post member 2520 fixed on the other side of the top plate 2510. For example, the mounting member 1710 may be welded substantially proximate to the center 2702 of the top plate 2510 opposite to the post member 2520 welded on the other side of the top plate 2510. FIG. 27A also illustrates fasteners 2514(1)-2514(4) for fastening the top plate 2510 and the bottom plate 2512 to the core 2504. While FIG. 27A illustrates four fasteners for fastening the top plate 2510 and the bottom plate 2512 to the core 2504, any number of fasteners may be used. These fasteners may comprise nuts that receive and couple with threaded bolts, although any other suitable fastener may be employed in other embodiments.

Figure 27B:
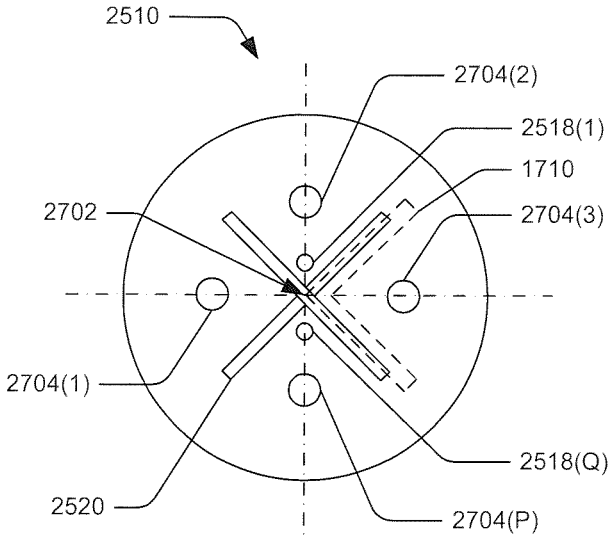

FIG. 27B illustrates a bottom view of the top plate 2510 of the structural cap 2502 illustrated in FIG. 25. As discussed above, the post member 2520 may be fixed substantially proximate to the center 2702 of the top plate 2510 opposite to the mounting member 1710. As illustrated, the post member 2520 may be a cruciform shear lug configured to resist shear loads experienced by a structural cap. FIG. 27B illustrates the cruciform shear lug comprises a post member having a cross-section in the form of a cross. The void 2516 of the core 2504 may receive the cruciform shear lug and a cementitious mixture to resist at least a shear load experienced by the structural cap 2502. Filling the core with a cementitious material will prevent displacement of the post member 2520. Further, the core is stiffened by filling the core with the cementitious material. In addition, because this core may comprise both a metal outer shell and may be configured to receive a cementitious mixture, this core may be known as a "composite core."

FIG. 27B also illustrates multiple through-holes 2704(1)-(N) arranged around the center 2702 of top plate 2510 for receiving threaded fasteners or other types of fasteners. For example, as FIGS. 27A and 27B illustrate the through-holes 2704(1)-(N) may be for receiving fasteners 2514(1)-2514(4), respectively. FIGS. 27A and 27B also illustrate the ports 2518(1) and 2518(Q) arranged around the center 2702 of the top plate 2510. As discussed above, the ports 2518(1) and 2518(Q) may vent the void 2516 of the core 2504 while receiving a cementitious mixture.

Figure 27C:
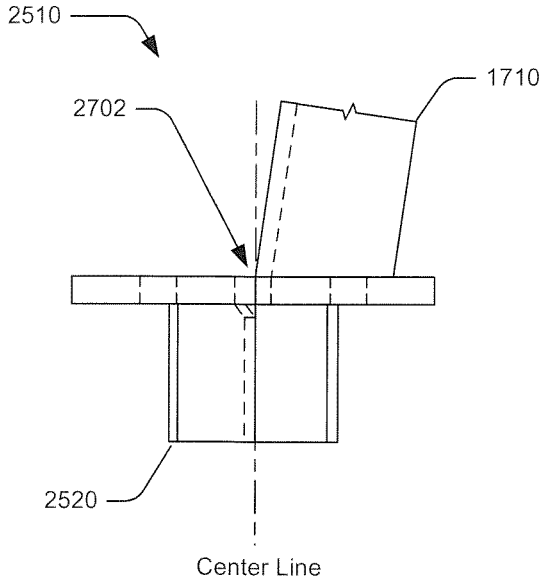

FIG. 27C illustrates a side view of the top plate 2510 of the structural cap 2502 illustrated in FIG. 25. FIG. 27C illustrates the post member 2520 may be fixed substantially proximate to the center 2702 of the top plate 2510 opposite to the mounting member 1710.

Figure 28:
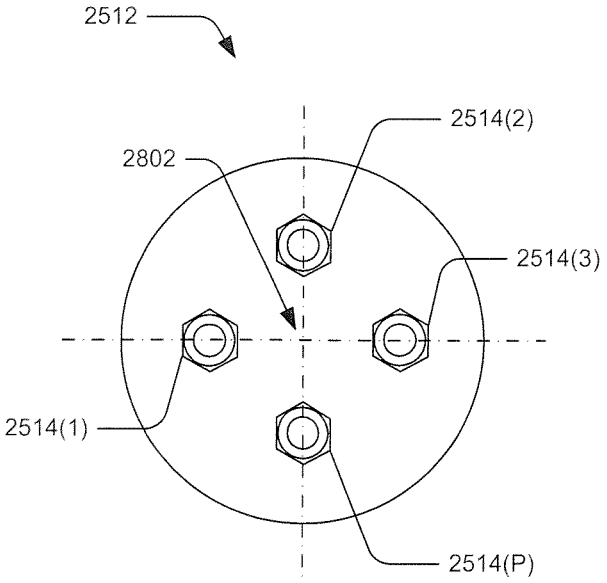
FIG. 28 is a bottom view of an illustrative bottom plate of the structural cap of FIG. 25.

FIG. 28 illustrates a bottom view of the bottom plate 2512 of the structural cap 2502 illustrated in FIG. 25. FIG. 28 also illustrates fasteners 2514(1)-2514(4) may be received by multiple through holes arranged around the a center 2802 of the bottom plate 2512 for sandwiching the core 2504 in-between the top plate 2510 and the bottom plate 2512.

Figure 29:
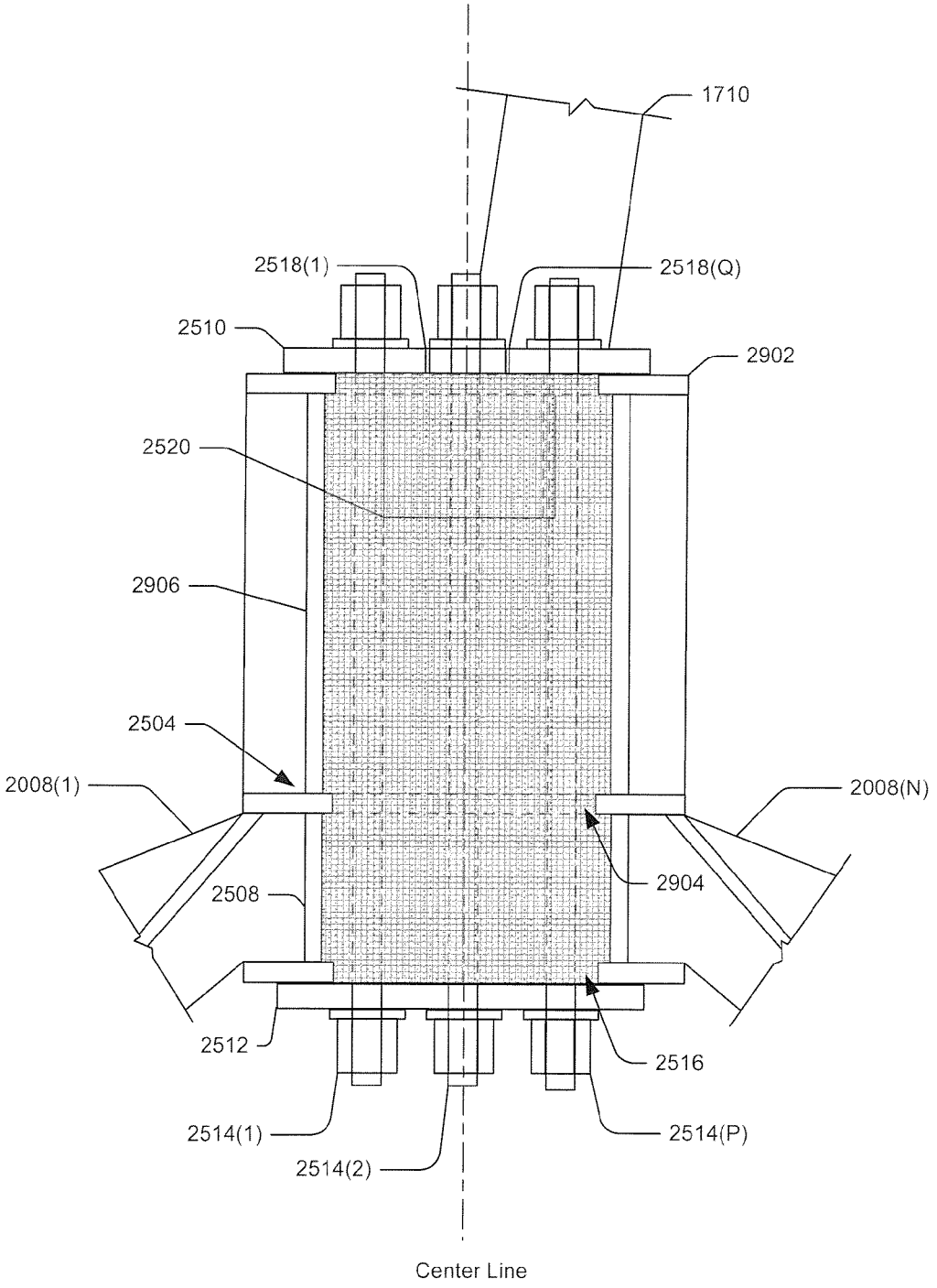
FIG. 29 is a section view of an illustrative riser. As illustrated, the riser includes a cementitious containment area and may be added to the core of structural cap of FIG. 25 and be interconnected with the cementitious area of the core of the structural cap.

FIG. 29 is a cross-section of an illustrative riser 2902 coupled to the core 2504 of the structural cap 2502 illustrated in FIG. 25. The riser 2902 is to provide for adjusting an elevation of the structural cap 2502. For example the riser 2902 allows an installer of cap 2502 to adjust an elevation of the mounting member 1710 to more precisely fit a location of the tower leg or other structural member to which structural cap 2502 couples. As illustrated, the riser 2902 defines another void 2904 distal to, and interconnected with, the void 2516 of the core 2504. The riser 2902 may comprises another tube 2906 in between the top plate 2510 of the core 2504 and the tube 2508 of the core 2504. With the riser 2902 residing between the top plate 2510 and the tube 2508, the void 2904 of the riser 2902 receives the post member 2520 attached to the top plate 2510 of the core 2504 opposite to the mounting member 1710.

While FIG. 29 illustrates the post member 2520 residing within the void 2904, a portion of the post member may also reside within the void 2516. For example, the post member may extend through the void 2904 and into the void 2516. As discussed above, the ports 2518(1) and 2518(Q) disposed in the top plate 2510 are configured to vent the void 2516 of the core 2504, which may also vent the void 2904 and the riser 2902 while receiving a cementitious mixture. As discussed above, one or more threaded fasteners 2514(1), 2514(2), . . . , 2514(P) may be tightened to secure the top plate 2510 and the bottom plate 2512 to the tube 2508 and the riser 2902. As discussed above, because the top plate 2510 rests flush against the tube 2906 of the riser 2902 and adjustably attaches via fasteners 2514(1)-2514(P) to the bottom plate 2512 of the core 2504, the top plate 2510 is adjustable translationally and/or rotationally relative to the tube 2508 of core 2504.

Example Process Installing a Structural Cap with a Core and Sleeves

Figure 30A:
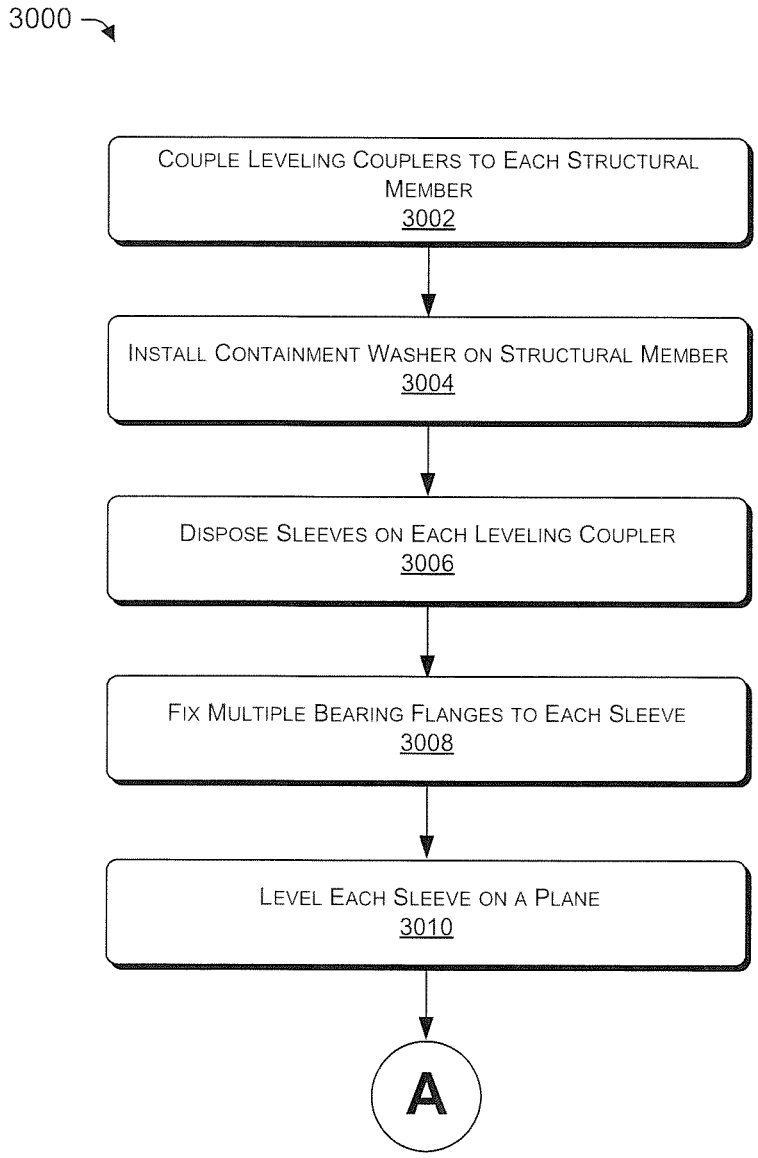
FIGS. 30A and 30B illustrates an alternative example process for installing a structural cap and sleeves to multiple structural members.
Figure 30B:
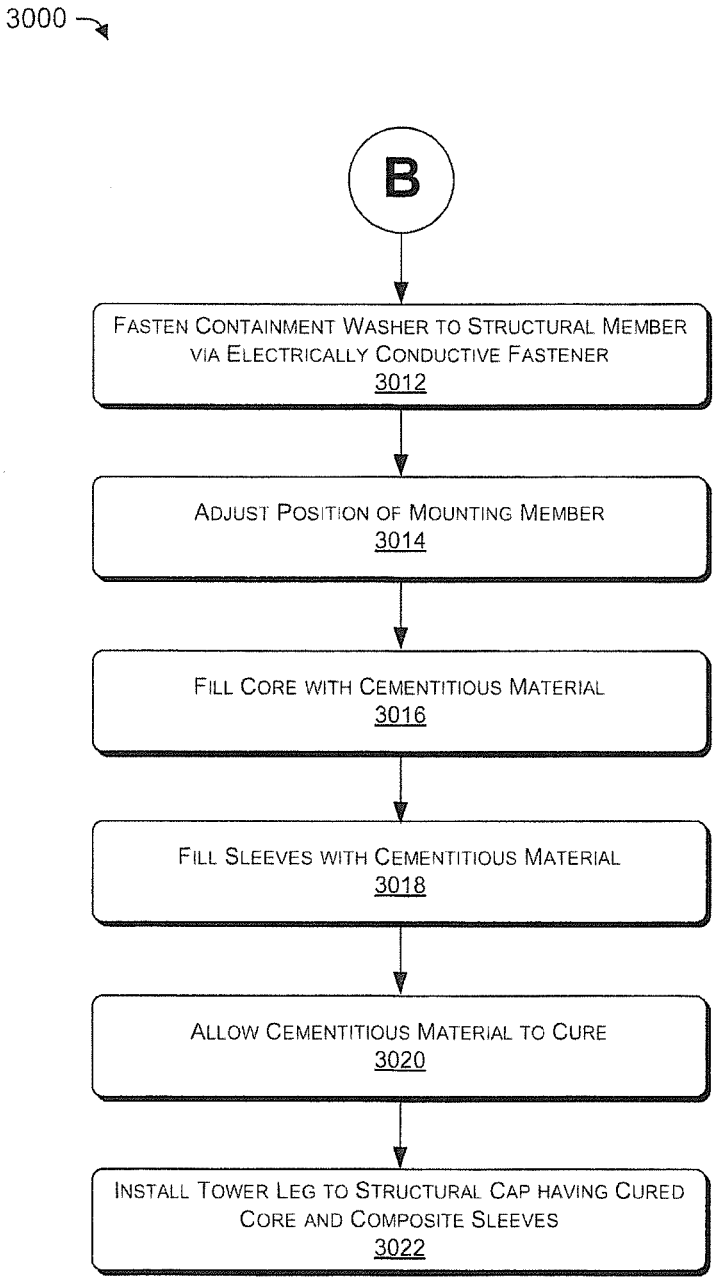

FIGS. 30A and 30B illustrate an example process 3000 for installing a structural cap to a group of structural members, such as a radial array of battered micropiles or any other group of structural members. Process 3000 starts on FIG. 30A and includes coupling, at operation 3002 a leveling coupler on each of the structural members. For instance, operation 3002 may couple a leveling coupler such that the leveling coupler is distal to a portion of each of the structural members. For example, each of the leveling couplers may be threaded to a respective threaded bar portion of each structural member. Process 3000 includes installing, at operation 3004, a containment washer on a structural member. For example, at operation 3004, a containment washer may be slipped onto the structural member. Process 3000 then proceeds to dispose, at operation 3006, a sleeve on each of the leveling couplers and the portion of each of the structural members. For instance, operation 3006 may dispose a sleeve on a portion of a pile such that the leveling coupler and the portion of the pile are disposed in a void of the sleeve.

Next, operation 3008 fixes multiple bearing flanges arranged along a perimeter of a core of the structural cap to each of the sleeves disposed on the leveling couplers and the portions of the structural members. To do so, each of the sleeves may be fastened to a respective bearing flange via threaded fasteners, via a weld, or in any other suitable manner.

Operation 3008 may be followed by operation 3010. Operation 3010 represents an operator of a site leveling each of the sleeves, via the leveling couplers, using a leveling jig or through another iterative process. For example, an operator of a site may raise and/or lower each sleeve to achieve a level plane. Further, an operator of a site may raise and/or lower each sleeve to achieve a level plane of a structural cap. In some instances, one or more of the sleeves are integral with a body of a structural cap, while in other instances the sleeves couple to the body of the cap after being placed on the structural members, as discussed below.

Process 3000 continues on FIG. 30B at operation 3012, where an operator fastens at least one containment washer to one of the structural members. As discussed above, the containment washer is disposed adjacent to an open end of the sleeve and encloses the sleeve to contain the cementitious material within the sleeve. Also as discussed above, the containment washer may include an electrically-conductive fastener fastening the containment washer adjacent to the open end of the sleeve. The conductive fastener electrically grounds the structural cap to the structural member.

Next, operation 3014 represents adjusting a position of a mounting member. For example, the mounting member fixed to a top plate may move translationally and/or rotationally relative to the core of the structural cap. The adjustability of the mounting member allows the installer of structural cap to adjust the mounting member to more precisely fit a location of a leg of a tower to which structural cap couples.

Next, operation 3016 represents filling the void of the core of the structural cap with a cementitious material, such as, grout, concrete, cement or the like, for fixedly coupling the structural cap to a tower leg or other structural member. For instance, an operator of work site 100 may choose to back-fill the void of the core via apertures and vent the void via a port while back-filling.

Next, operation 3018 represents filling each of the voids of the sleeves with the cementitious material for fixedly coupling each of the sleeves to the portion of the respective structural member disposed in the sleeve. For instance, an operator of work site 100 may choose to back-fill the void of the sleeve via apertures and vent the void via a port while back-filling. After allowing the cementitious material to cure at operation 3020, the operator may install the tower leg to the structural cap having cured core and cured sleeves at operation 3022.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

We claim:

1. A structural cap for anchoring a leg of a tower to a radial array of micropiles, the structural cap comprising;

a body having a center and a perimeter;

a mounting member attached to and protruding from the body substantially at the center of the body, the mounting member for receiving the leg of the tower;

a bearing flange disposed on the perimeter of the body; and a sleeve configured to couple to the bearing flange and defining a void to: (1) receive a portion of one micropile of the radial array of micropiles, and (2) receive a cementitious mixture about the portion of the micropile for fixedly coupling the sleeve to the portion of the micropile, wherein:

the sleeve includes a plate at an end of the sleeve for fastening the sleeve to the bearing flange, the plate of the sleeve including an aperture disposed substantially proximate to a center of a perimeter of the plate for receiving another portion of the micropile distal to the portion received by the void of the sleeve; and the bearing flange includes an aperture for also receiving the another portion of the micropile distal to the portion received by the void of the sleeve.

2. The structural cap as recited in claim 1, wherein the sleeve also includes one or more ports arranged around the aperture of the sleeve, the one or more ports for venting the void of the sleeve while receiving the cementitious mixture.

3. The structural cap as recited in claim 1, wherein the sleeve detachably couples to the bearing flange via fasteners.

4. The structural cap as recited in claim 1, wherein the sleeve is fixed to the bearing flange via a weld that is about the perimeter of the plate of the sleeve.

5. The structural cap as recited in claim 1, wherein:

the plate of the sleeve includes multiple through-holes arranged around the perimeter of the plate of the sleeve for receiving threaded fasteners; and the bearing flange includes multiple through-holes arranged around the aperture of the bearing flange for also receiving the threaded fasteners.

6. The structural cap as recited in claim 1, further comprising a packing ring disposed adjacent to an open end of the sleeve distal to the plate of the sleeve for enclosing the void defined by the sleeve.

7. The structural cap as recited in claim 1, wherein the body includes multiple through-holes in the body, and wherein the mounting member comprises:

a plate configured to be disposed flush against a portion of the body substantially at the center of the body, the plate having through holes arranged around a perimeter of the plate for receiving threaded fasteners;

a stub angle protruding from the plate of the mounting member and welded substantially proximate to a center of the plate of the mounting member, the stub angle configured to fasten to the leg of the tower; and a pair of fastening rings disposed on opposite sides of the body of the structural cap, each fastening ring having multiple through-holes for also receiving the threaded fasteners.

8. The structural cap as recited in claim 7, wherein a position of the mounting member relative to the body of the structural cap is adjustable.

9. The structural cap as recited in claim 1, wherein the bearing flange has an angle that substantially matches a predetermined batter angle of a micropile of the radial array of micropiles.

10. The structural cap as recited in claim 1, wherein the body comprises a substantially circular plate.

11. The structural cap as recited in claim 1, wherein the body comprises an outer shell defining a cementitious containment area within the outer shell, the cementitious containment area for receiving and containing a cementitious mixture for stiffening the outer shell.

12. A structural cap for anchoring a leg of a tower to a group of structural members, the structural cap comprising:

a body having a perimeter;

a bearing flange disposed on the perimeter of the body; and a sleeve configured to couple to the bearing flange and defining a void to: (1) receive a portion of the one of the structural members, and (2) receive a cementitious mixture about the portion of the structural member, wherein:

the sleeve includes a plate fixed on an end of the sleeve for fastening the sleeve to the bearing flange, the plate including an aperture disposed substantially proximate to a center of a perimeter of the plate for receiving another portion of the structural member distal to the portion received by the void; and the bearing flange includes an aperture for receiving the another portion of the structural member distal to the portion received by the void.

13. The structural cap as recited in claim 12, further comprising one or more ports disposed in the plate and arranged around the aperture for venting the void while receiving the cementitious mixture.

14. The structural cap as recited in claim 12, wherein the plate is fixed to the bearing flange via a weld that is about the perimeter of the plate.

15. The structural cap as recited in claim 12, wherein:

the plate includes multiple through-holes arranged around the perimeter of the plate for receiving threaded fasteners; and the bearing flange includes multiple through-holes equally arranged around the aperture of the bearing flange as the multiple through-holes arranged around the perimeter of the plate for also receiving the threaded fasteners.

16. The structural cap as recited in claim 15, wherein the sleeve couples to the bearing flange via the threaded fasteners, the threaded fasteners being disposed in the multiple through-holes arranged around the perimeter of the plate and in the multiple through-holes arranged in the bearing flange.

17. The structural cap as recited in claim 12, further comprising a packing ring disposed adjacent to an open end of the sleeve distal to the plate for enclosing the void.

18. The structural cap as recited in claim 12, wherein the sleeve comprises a substantially circular tube.

19. A structural cap for anchoring a leg of a tower to a radial array of micropiles, the structural cap comprising;

a core having a tube, a bottom plate, a top plate, a post member attached to a first surface of the top plate, and a mounting member attached to a second surface of the top plate opposite the first side to receive the leg of the tower, the core defining a void to: (1) receive the post member attached to the top plate of the core opposite the mounting member, and (2) receive and contain a cementitious mixture about the post member;

a bearing flange attached to a perimeter of the core; and a sleeve configured to couple to the bearing flange and defining another void to: (1) receive a portion of one micropile of the radial array of micropiles, and (2) receive a cementitious mixture about the portion of the micropile for fixedly coupling the sleeve to the portion of the micropile.

20. The structural cap as recited in claim 19, wherein:

the top plate includes multiple through-holes for receiving threaded fasteners;

the bottom plate includes multiple through-holes for also receiving the threaded fasteners, and the tube resides in between the top plate and the bottom plate when assembled for receiving a portion of the post member attached to the top plate and a portion of the threaded fasteners received by the top plate and the bottom plate.

21. The structural cap as recited in claim 20, wherein the top plate also includes one or more ports for venting the void of the core while receiving the cementitious mixture.

22. The structural cap as recited in claim 20, wherein the core further comprises a riser defining another void distal to, and interconnected with, the void of the core.

23. The structural cap as recited in claim 22, wherein the riser comprises another tube in between the top plate and the tube when assembled.

24. The structural cap as recited in claim 20, wherein:

the post member comprises a cruciform shear lug protruding from the top plate and welded substantially proximate to a center of the top plate; and the mounting member comprises a stub angle protruding from the top plate opposite to the cruciform shear lug, the stub angle configured to fasten to the leg of the tower.

25. The structural cap as recited in claim 19, wherein:

the void of the sleeve further receives a leveling coupler coupled distal to the portion of the one micropile of the radial array of micropiles for leveling the structural cap, and wherein the void of the sleeve further receives the cementitious mixture about the leveling coupler and the portion of the micropile for fixedly coupling the sleeve to the portion of the micropile.

26. The structural cap as recited in claim 25, wherein:

the sleeve includes a plate at a first end of the sleeve for fastening the sleeve to the bearing flange, the plate of the sleeve including an aperture disposed substantially proximate to a center of the plate of the sleeve for receiving a portion of a fastening member coupled to the leveling coupler; and the bearing flange includes an aperture for also receiving another portion of the fastening member coupled distal to the leveling coupler.

27. The structural cap as recited in claim 26, wherein the sleeve also includes one or more ports arranged around the aperture, the one or more ports for venting the void of the sleeve while receiving the cementitious mixture.

28. The structural cap as recited in claim 26, wherein the sleeve detachably couples to the bearing flange via fasteners.

29. The structural cap as recited in claim 26, wherein the sleeve is fixed to the bearing flange via a weld that is about the perimeter of the plate of the sleeve.

30. The structural cap as recited in claim 26, wherein:

the plate of the sleeve includes multiple through-holes for receiving threaded fasteners; and the bearing flange includes multiple through-holes for also receiving the threaded fasteners.

31. The structural cap as recited in claim 26, further comprising a containment washer disposed adjacent to an open end of the sleeve distal to the plate of the sleeve for enclosing the void defined by the sleeve, the containment washer coupled to an electrically-conductive fastener to: (1) fasten the containment washer adjacent to the open end of the sleeve distal to the plate of the sleeve, and (2) electrically ground the structural cap to the micropile.

32. The structural cap as recited in claim 31, wherein the electrically-conductive fastener comprises a J-bolt configured to hook on an end of the portion of the micropile received by the sleeve and configured to thread onto the containment washer disposed adjacent to the open end of the sleeve.

33. The structural cap as recited in claim 19, wherein a position of the mounting member relative to the core of the structural cap is adjustable.

34. The structural cap as recited in claim 19, wherein the bearing flange has an angle that substantially matches a predetermined batter angle of a micropile of the radial array of micropiles.

35. A structural cap for anchoring a leg of a tower to a group of structural members, the structural cap comprising:

a core having a perimeter and defining a void to: (1) receive a post member, and (2) receive a cementitious mixture about the post member;

a bearing flange disposed on the perimeter of the core;

a sleeve comprising a substantially circular tube, a substantially oval tube, or a substantially polygonal tube, the sleeve configured to couple to the bearing flange and defining another void to: (1) receive a portion of one of the structural members, and (2) receive a cementitious mixture about the portion of the structural member; and a leveling coupler configured to be arranged in the void of the sleeve for leveling the structural cap, the leveling coupler configured to adjustably couple a portion of the structural member received by the sleeve to a fastening member extending distal to the leveling coupler.

36. The structural cap as recited in claim 35, wherein the core comprises:

a tube having a first open end and a second open end opposite the first open end;

a top plate configured to be disposed flush against the first open end of the tube and comprising:

the post member protruding from the top plate, attached substantially proximate to a center of the top plate, and being received by the first open end of the tube;

a mounting member protruding from the top plate, opposite to the post member protruding from the top plate, and attached substantially proximate to the center of the top plate of the core;

one or more through holes arranged on the top plate for receiving threaded fasteners;

one or more ports arranged around the top plate for venting the void while receiving the cementitious mixture;

a bottom plate configured to be disposed flush against the second open end and having through-holes arranged on the bottom plate for receiving the threaded fasteners.

37. The structural cap as recited in claim 36, wherein a position of the top plate relative to the tube of the core is adjustable.

38. The structural cap as recited in claim 36, wherein the tube comprises a substantially circular tube.

39. The structural cap as recited in claim 35, wherein:

the sleeve includes a plate fixed on an end of the sleeve for fastening the sleeve to the bearing flange, the plate of the sleeve including an aperture disposed substantially proximate to a center of a perimeter of the plate of the sleeve for receiving a portion of the fastening member extending distal to the leveling coupler; and the bearing flange includes an aperture for receiving the portion of the fastening member extending distal to the leveling coupler.

40. The structural cap as recited in claim 39, further comprising one or more ports disposed in the plate of the sleeve and arranged around the aperture for venting the void of the sleeve while receiving the cementitious mixture.

41. The structural cap as recited in claim 39, wherein the plate of the sleeve is attached to the bearing flange via a weld that is about the perimeter of the plate of the sleeve.

42. The structural cap as recited in claim 39, wherein:

the plate of the sleeve includes multiple through-holes arranged for receiving threaded fasteners; and the bearing flange includes multiple through-holes equally arranged around the aperture of the bearing flange as the multiple through-holes arranged in the plate of the sleeve for also receiving the threaded fasteners.

43. The structural cap as recited in claim 39, wherein the sleeve couples to the bearing flange via the threaded fasteners, the threaded fasteners being disposed in the multiple through-holes arranged in the plate of the sleeve and in the multiple through-holes arranged in the bearing flange.

44. The structural cap as recited in claim 39, further comprising a containment washer disposed adjacent to an open end of the sleeve distal to the plate of the sleeve for enclosing the void.

45. The structural cap as recited in claim 44, further comprising an electrically-conductive fastener fastening the containment washer disposed adjacent to the open end of the sleeve to a portion of the structural member and electrically grounding the structural cap to the structural member.

46. A structural cap for anchoring a leg of a tower to a radial array of micropiles, the structural cap comprising;

a body having a center and a perimeter;

a mounting member attached to and protruding from the body substantially at the center of the body, the mounting member for receiving the leg of the tower;

a bearing flange disposed on the perimeter of the body; and a sleeve configured to couple to the bearing flange and defining a void to: (1) receive a portion of one micropile of the radial array of micropiles, and (2) receive a cementitious mixture about the portion of the micropile for fixedly coupling the sleeve to the portion of the micropile, wherein the sleeve comprises a leveling coupler arranged in the void of the sleeve for leveling the structural cap, the leveling coupler configured to adjustably couple a portion of the micropile received by the sleeve to a fastening member extending distal to the leveling coupler.

47. A structural cap for anchoring a leg of a tower to a group of structural members, the structural cap comprising:

a core having a perimeter and defining a void to: (1) receive a post member, and (2) receive a cementitious mixture about the post member;

a bearing flange disposed on the perimeter of the core; and a sleeve configured to couple to the bearing flange and defining another void to: (1) receive a portion of one of the structural members, and (2) receive a cementitious mixture about the portion of the structural member, wherein the sleeve comprises a leveling coupler arranged in the void of the sleeve for leveling the structural cap, the leveling coupler configured to adjustably couple a portion of the structural member received by the sleeve to a fastening member extending distal to the leveling coupler.

48. A structural cap for anchoring a leg of a tower to a group of structural members, the structural cap comprising:

a body having a perimeter;

a bearing flange disposed on the perimeter of the body;

a sleeve comprising a substantially circular tube, a substantially oval tube, or a substantially polygonal tube, the sleeve configured to couple to the bearing flange and defining a void to: (1) receive a portion of the one of the structural members, and (2) receive a cementitious mixture about the portion of the structural member; and a leveling coupler configured to be arranged in the void of the sleeve for leveling the structural cap, the leveling coupler configured to adjustably couple a portion of the structural member received by the sleeve to a fastening member extending distal to the leveling coupler.

49. A structural cap for anchoring a leg of a tower to a group of structural members, the structural cap comprising:

a core having a perimeter and defining a void to: (1) receive a post member, and (2) receive a cementitious mixture about the post member, wherein the core comprises:

a tube having a first open end and a second open end opposite the first open end;

a top plate configured to be disposed flush against the first open end of the tube and comprising:

the post member protruding from the top plate, attached substantially proximate to a center of the top plate, and being received by the first open end of the tube;

a mounting member protruding from the top plate, opposite to the post member protruding from the top plate, and attached substantially proximate to the center of the top plate of the core;

one or more through holes arranged on the top plate for receiving threaded fasteners;

one or more ports arranged around the top plate for venting the void while receiving the cementitious mixture;

a bottom plate configured to be disposed flush against the second open end and having through-holes arranged on the bottom plate for receiving the threaded fasteners;

a bearing flange disposed on the perimeter of the core;

a sleeve comprising a substantially circular tube, a substantially oval tube, or a substantially polygonal tube, the sleeve configured to couple to the bearing flange and defining another void to: (1) receive a portion of one of the structural members, and (2) receive a cementitious mixture about the portion of the structural member.

50. A structural cap for anchoring a leg of a tower to a radial array of micropiles, the structural cap comprising;

a body having a center and a perimeter;

a mounting member attached to and protruding from the body substantially at the center of the body, the mounting member for receiving the leg of the tower, wherein the body includes multiple through-holes in the body, and wherein the mounting member comprises:

a plate configured to be disposed flush against a portion of the body substantially at the center of the body, the plate having through holes arranged around a perimeter of the plate for receiving threaded fasteners;

a stub angle protruding from the plate of the mounting member and welded substantially proximate to a center of the plate of the mounting member, the stub angle configured to fasten to the leg of the tower; and a pair of fastening rings disposed on opposite sides of the body of the structural cap, each fastening ring having multiple through-holes for also receiving the threaded fasteners;

a bearing flange disposed on the perimeter of the body; and a sleeve configured to couple to the bearing flange and defining a void to: (1) receive a portion of one micropile of the radial array of micropiles, and (2) receive a cementitious mixture about the portion of the micropile for fixedly coupling the sleeve to the portion of the micropile.

* * * * *